United States Patent [19]

Eiben et al.

[11] 3,964,659

[45] June 22, 1976

[54] SAFETY FIRING CONTROL MEANS FOR A FLUID OPERATED TOOL

[75] Inventors: Frank J. Eiben; Eric H. Halbert, both of Cincinnati; William T. Jobe, Bethel, all of Ohio; Carl Siegmann, Bremen, Germany

[73] Assignee: Senco Products, Inc., Cincinnati, Ohio

[22] Filed: Mar. 12, 1975

[21] Appl. No.: 557,756

[52] U.S. Cl. ..... 227/8; 227/130; 227/7

[51] Int. Cl.[2] ..... B25C 1/04

[58] Field of Search ..... 227/7, 8, 130

[56] References Cited

UNITED STATES PATENTS

| | | | |
|---|---|---|---|
| 3,170,487 | 2/1965 | Juilfs et al. | 227/130 X |
| 3,278,104 | 10/1966 | Becht et al. | 227/130 |
| 3,278,106 | 10/1966 | Becht et al. | 227/8 |
| 3,730,414 | 5/1973 | Becht | 227/130 |
| 3,808,620 | 5/1974 | Rothfuss et al. | 227/130 X |

*Primary Examiner*—Granville Y. Custer, Jr.
*Attorney, Agent, or Firm*—Melville, Strasser, Foster & Hoffman

[57] ABSTRACT

In a fluid operated tool of the type having firing control means comprising two separate and independent triggering means shiftable independently and in any order between normal and firing positions and requiring both triggering means to be concurrently in their firing positions to actuate the tool, safety means introducing into the firing sequence of the firing control means a time limit within which both triggering means must achieve their firing positions. If both triggering means do not achieve their firing positions within the time limit, the firing sequence must be reinitiated with a selected one or both of the triggering means initially in their normal positions.

29 Claims, 18 Drawing Figures

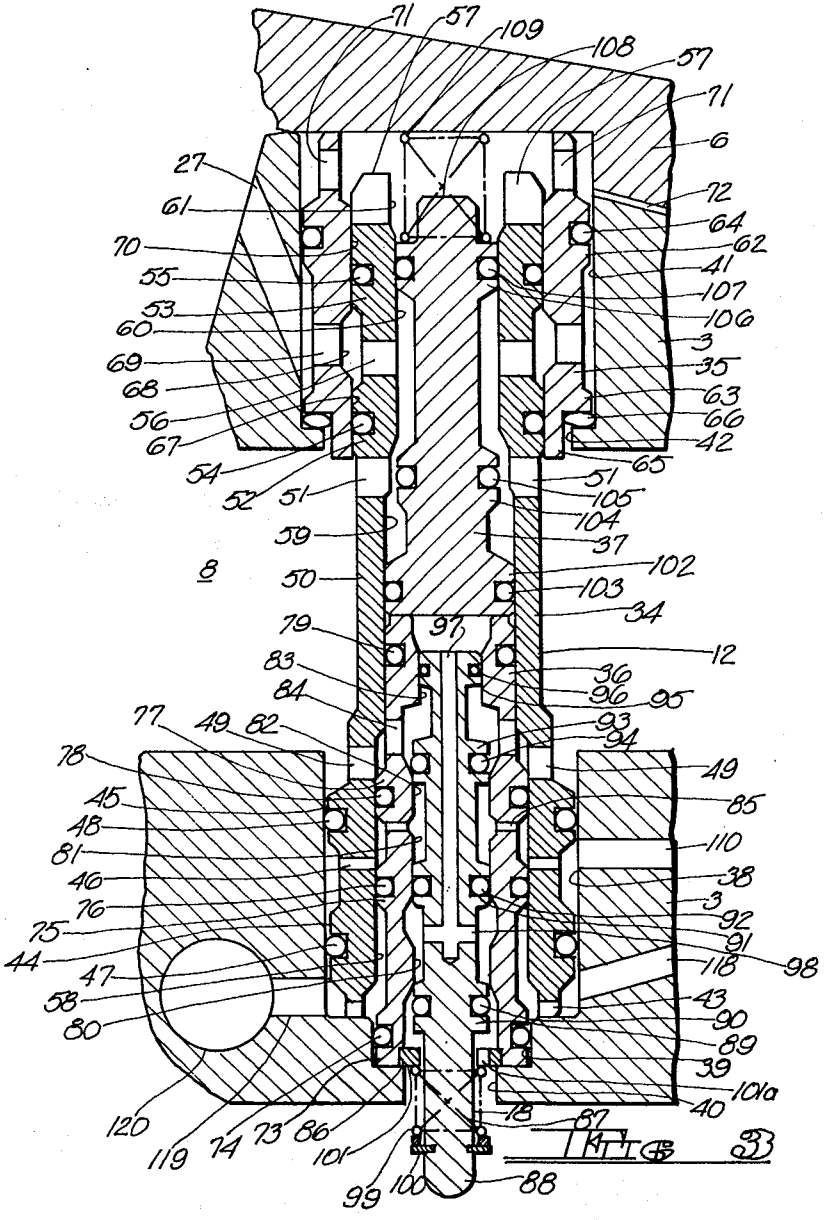
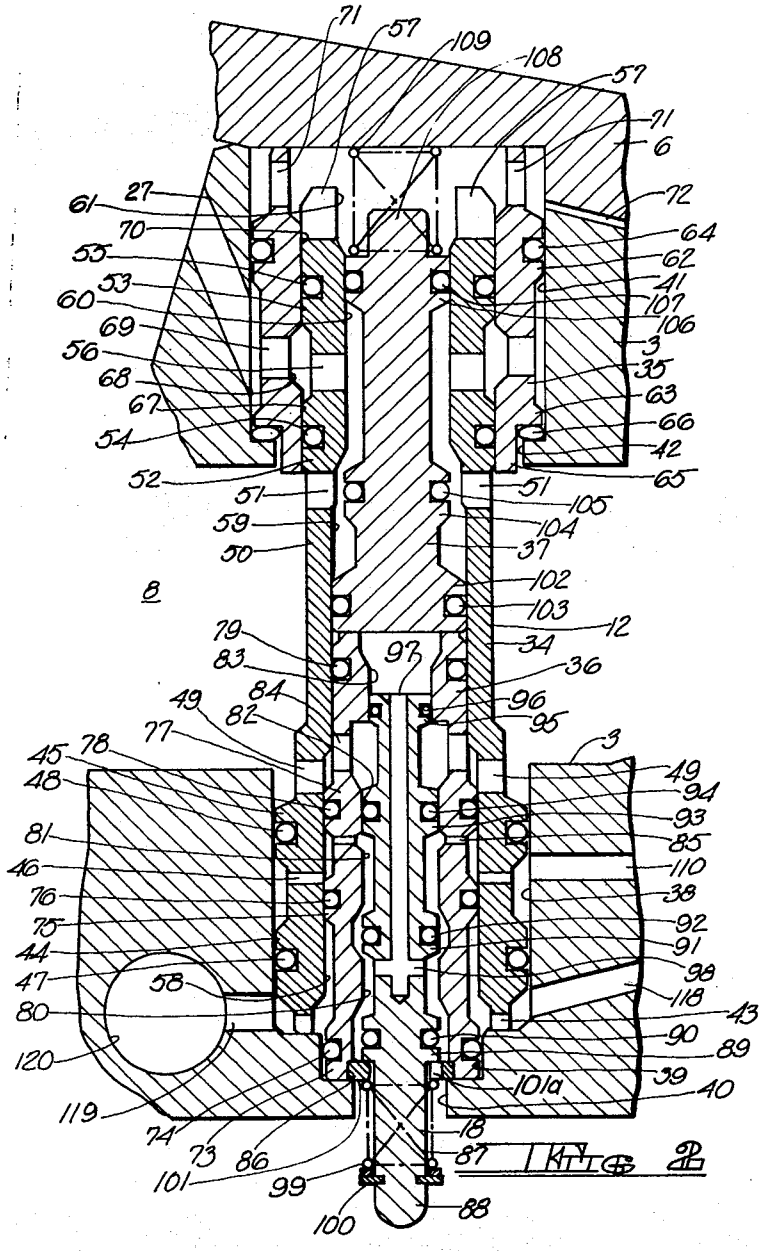

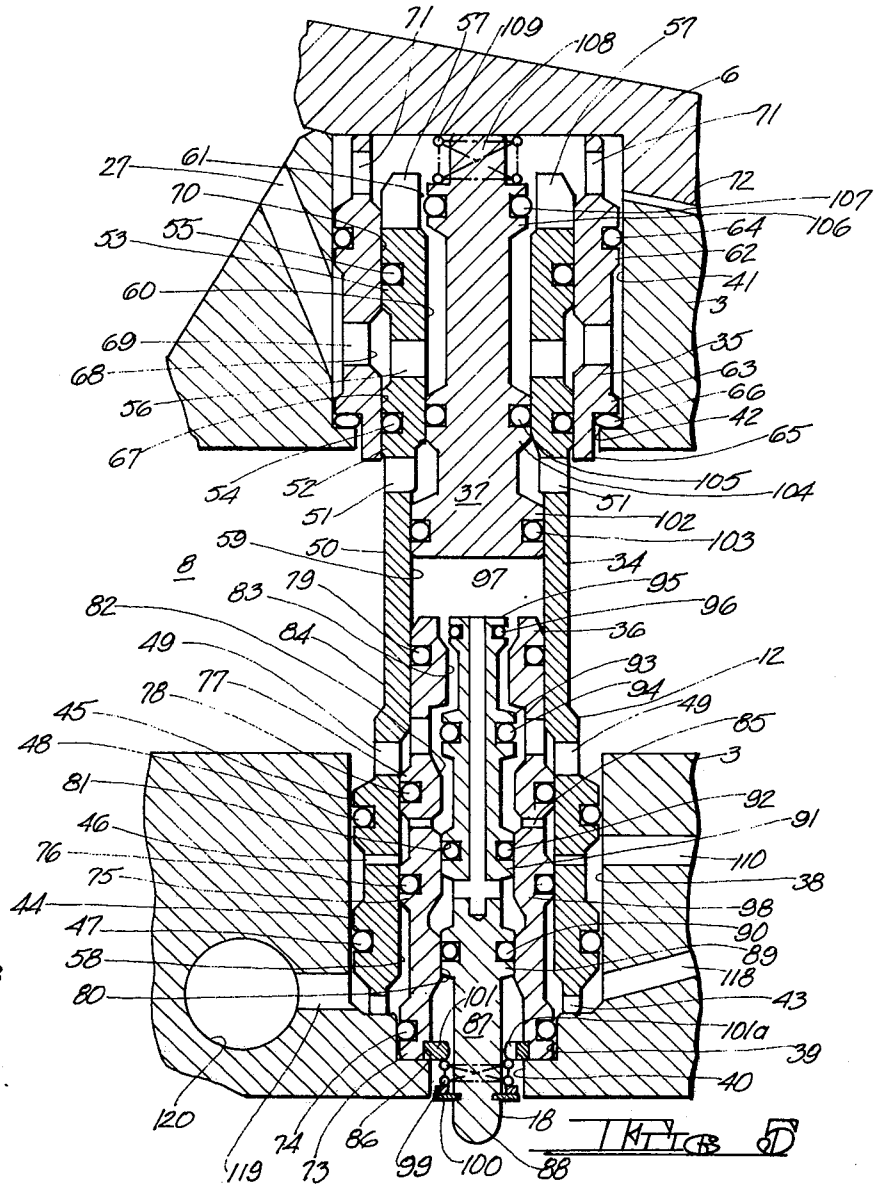
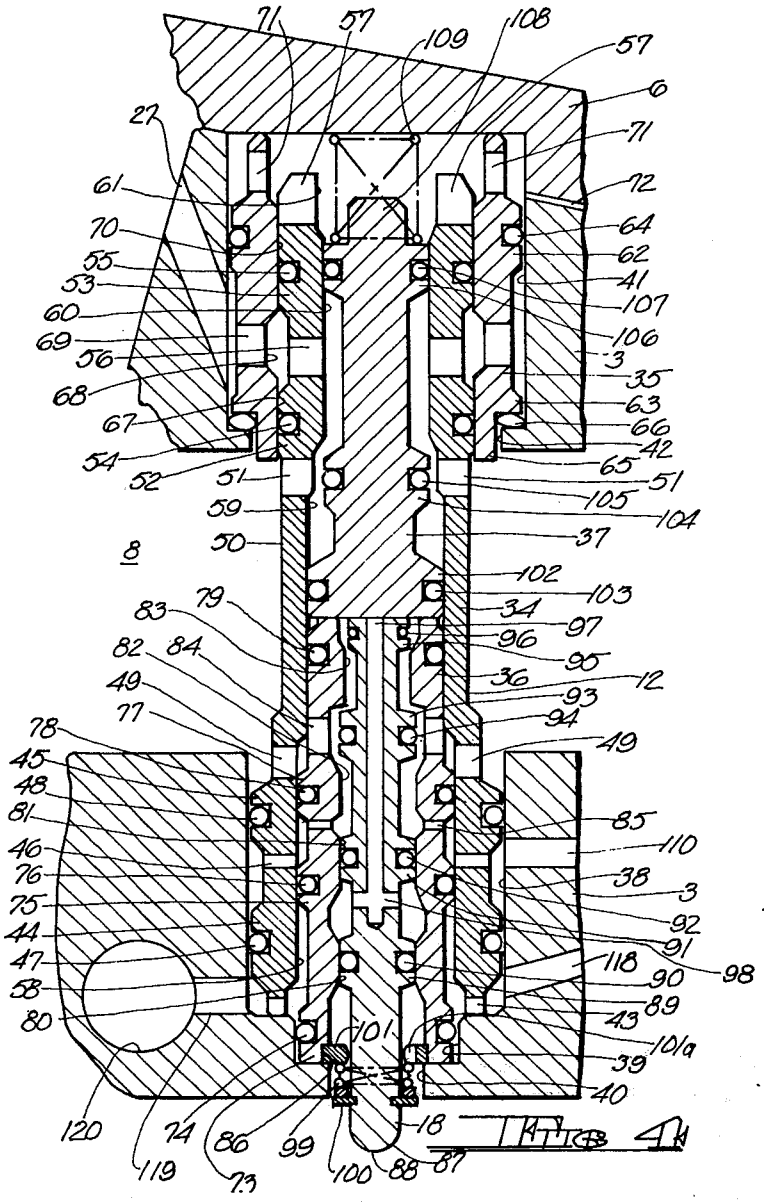

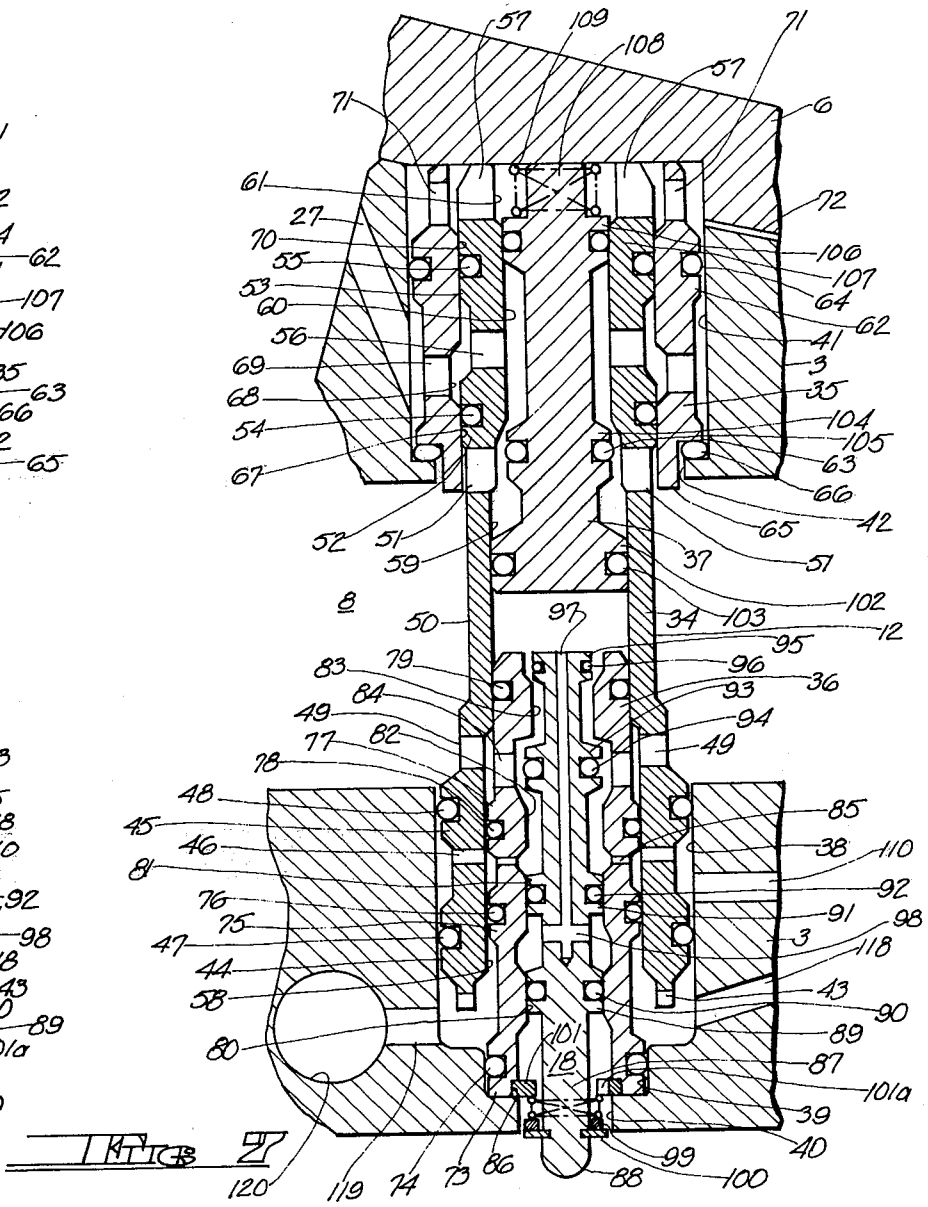
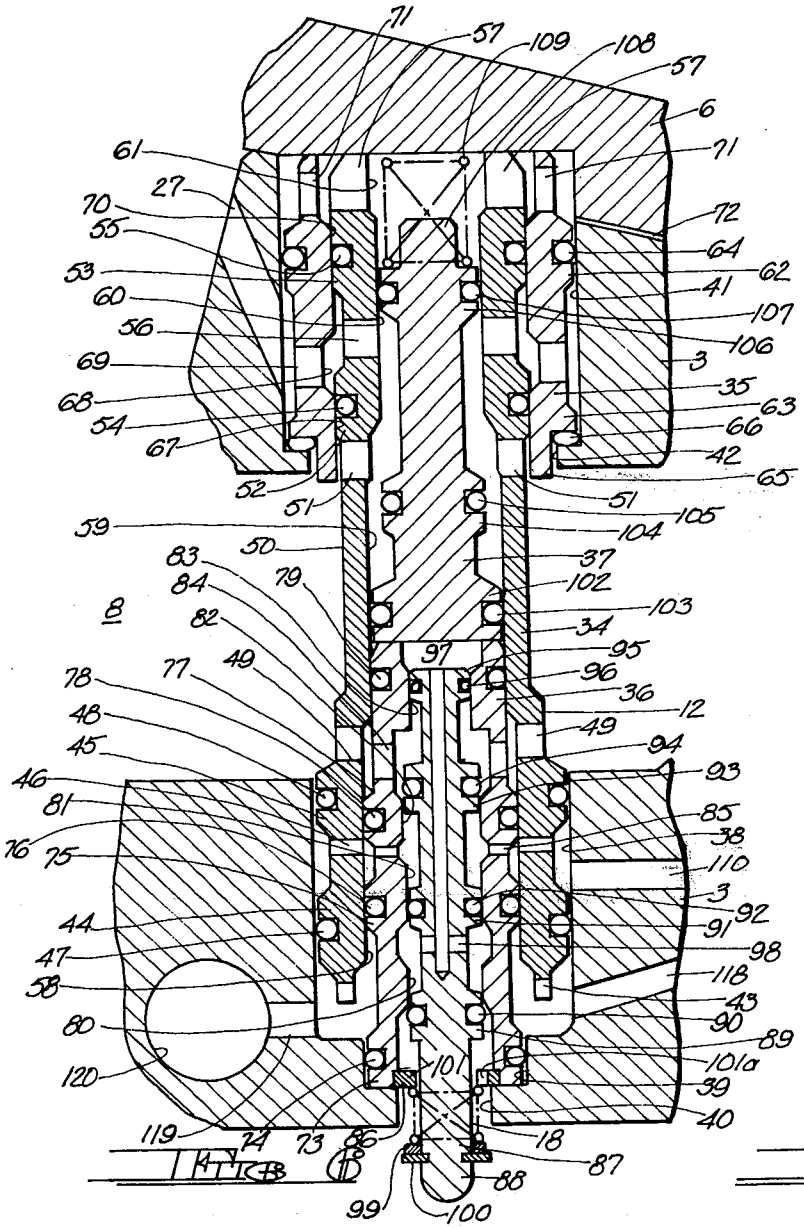

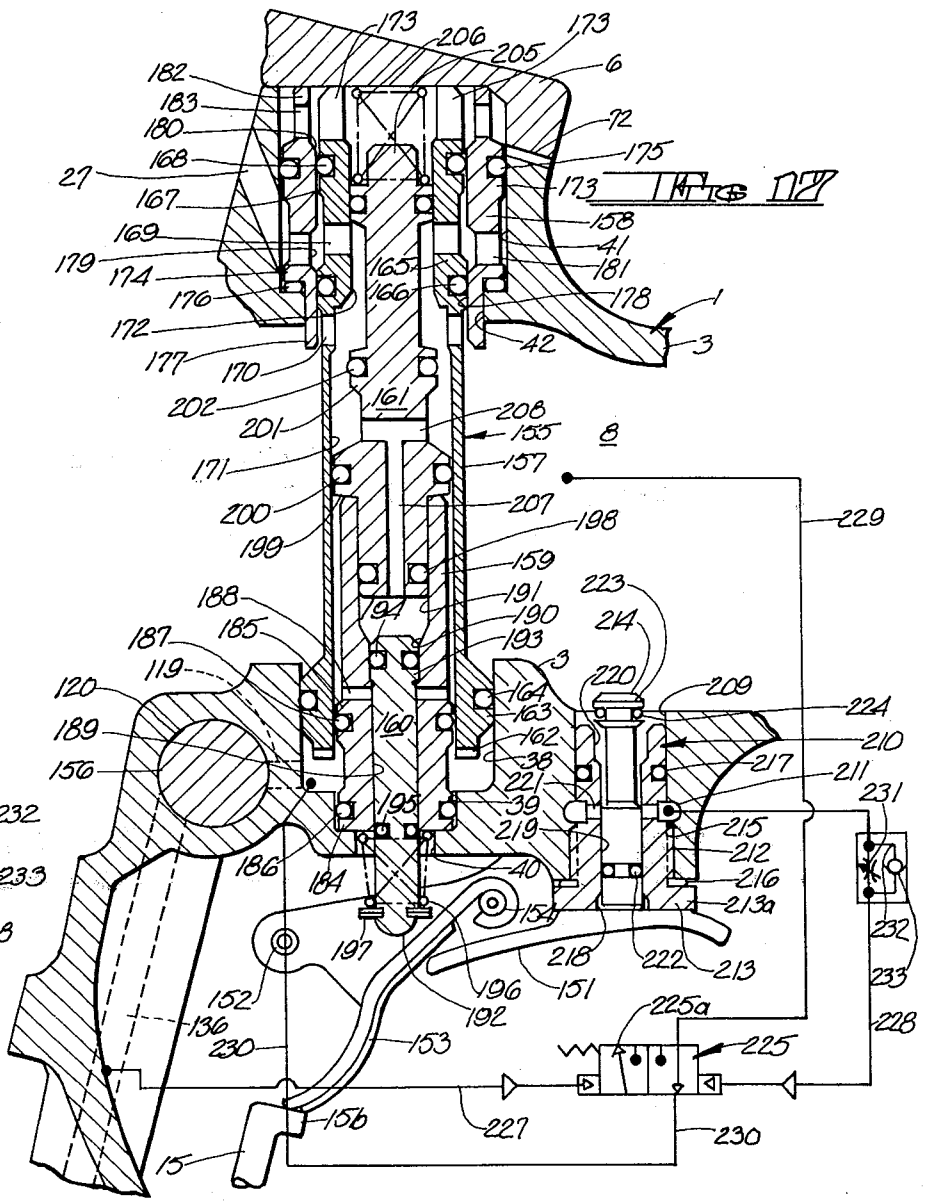
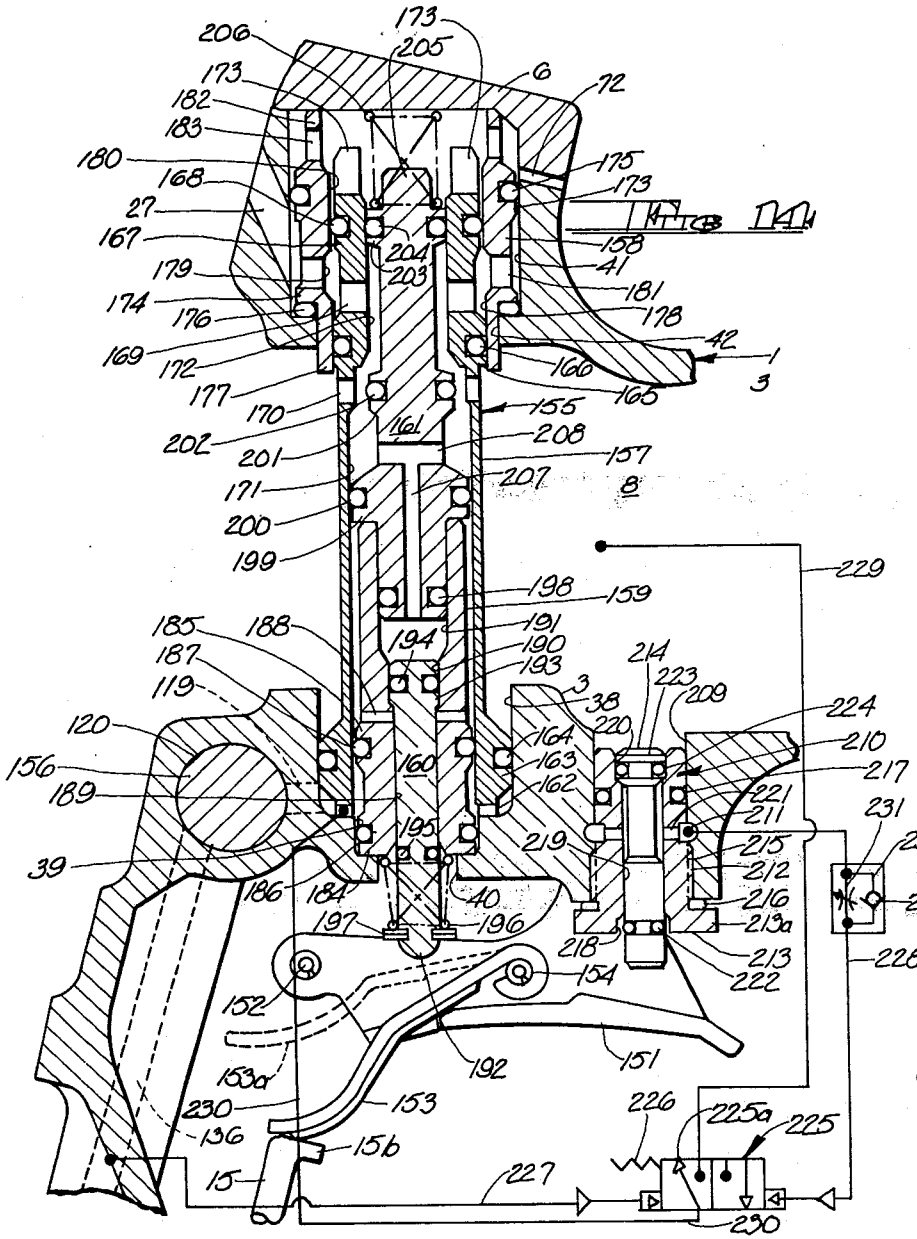

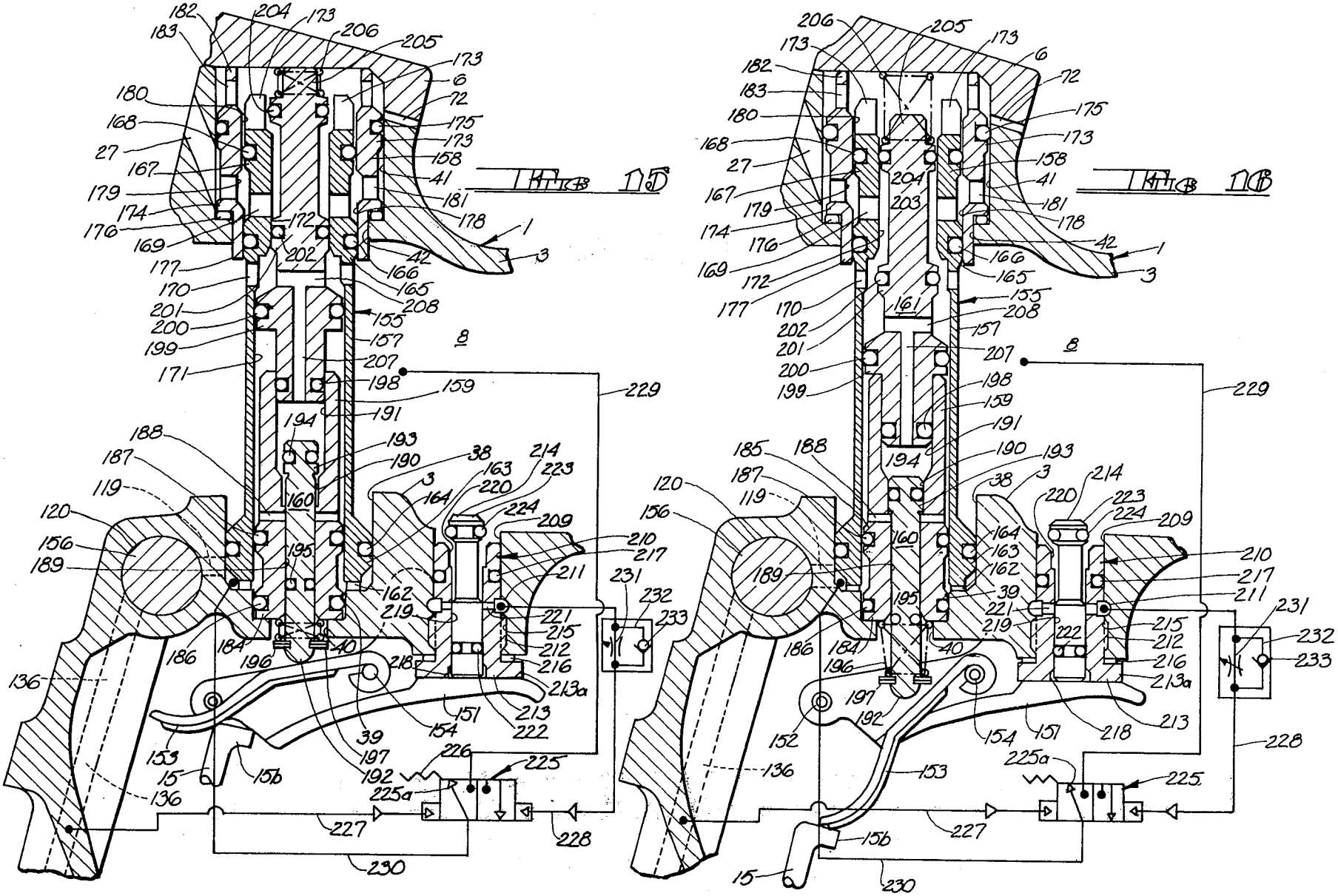

SAFETY FIRING CONTROL MEANS FOR A FLUID OPERATED TOOL

BACKGROUND OF THE INVENTION

1. Field of the Invention

The invention relates to safety means for a fluid operated tool of the type having firing control means comprising two separate and independent triggering means and requiring both triggering means to be concurrently in their firing positions to actuate the tool. More particularly, the invention relates to safety means introducing into the firing sequence of the firing control means a time limit within which both triggering means must achieve their firing positions.

2. Description of the Prior Art

The safety means of the present invention is applicable to any fluid operated tool of the type having two separate and independent triggering means, both of which must concurrently be in their firing positions to enable actuation of the tool. The invention is readily applicable, for example, to pneumatic fastener applying devices such as stapling tools or nailing tools. While not intended to be so limited, for purposes of an exemplary showing the safety means of the present invention will be described in terms of its application to a pneumatic fastener applying device of the general type set forth in U.S. Pat. No. 3,170,487. The tool may be provided with any appropriate separate and independent triggering means. Again, for purposes of an exemplary showing, the tool will be described as having separate triggering means similar to those set forth in U.S. Pat. No. 3,278,106.

In recent years, prior art workers have been continuously developing fastener applying devices capable of driving larger and larger fastener elements and characterized by increased speeds of operation. Along with the increased capabilities of these fastener applying devices have come increased safety hazards, it being understood that a fastener applying device with sufficient power to drive a large fastener element is at the same time capable of firing the fastener element a considerable distance through the air with the resultant possibility of injury.

To overcome these hazards, prior art workers have devised a number of safety devices. Primary among these was the firing control means having two separate and independent triggering means, both of which must be concurrently in their firing positions to actuate the fastener applying tool. The separate and independent triggering means for fastener applying tools are generally in the form of a manual trigger and a workpiece responsive trip.

The above mentioned U.S. Pat. No. 3,278,106 taught independent triggering means shiftable to their firing positions in any order, materially increasing the rate of operation of the tool while maintaining the safety advantage of the dual triggering means system.

However, a hazard still arises when a tool of the type taught in U.S. Pat. No. 3,278,106 is carried around with the manual trigger in its firing position. Anything brushing against the workpiece responsive trip with sufficient force to shift it to its firing position will fire a fastener into the brushing object, whether it be animate or inanimate. If the manual trigger is unintentionally shifted to its firing position or held in its firing position by the operator, which action may be subconscious, and if the workpiece responsive trip is brushed with sufficient force against a portion of the operator's body, and undesired portion of the workpiece or any other element, a fastener may be fired. If a fastener is unintentionally driven against a hard, tough or brittle element, the fastener may ricohet or scatter fragments of the element at high speed.

The safety means of the present invention greatly reduces these hazards through the basic concept of providing a time limit within which both separate and independent triggering means must reach their firing positions to enable operation of the tool. The independent triggering means may be shifted to their firing positions in any order, but if they are not concurrently in their firing positions within the required time limit a lock-out device is actuated which prevents firing of the tool. If the lock-out device is activated, it can only be deactivated by the return of a selected one or both of the triggering means to their normal positions.

The functions of the safety means of the present invention can be embodied in a number of different ways such as through the use of cam means, levers or linkages, various combinations of valves, combinations of valves and mechanical linkages, moving or non-moving part fluidic devices or such devices in combination with valves, linkages and the like. The various elements used to implement the safety means of the present invention may be actuated pneumatically, mechanically, magnetically or by other appropriate means. Similarly, the lock-out device may take any appropriate form and may prevent firing of the tool through any suitable means.

The lock-out device prevents firing of the tool after the expiration of the time limit imposed by the safety means of the present invention. The time limit may be initiated by the manual trigger and not the workpiece responsive trip; by the workpiece responsive trip and not by the manual trigger; or, in a preferred embodiment, by that one of the manual trigger and the workpiece responsive trip which is shifted to its firing position first. Actuation of the other previously released triggering means so that both triggering means are in the firing position within the time limit, will fire the tool. Actuation of the other previously released triggering means after the time limit, so that both triggering means are not concurrently in their firing positions within the time limit, will not fire the tool. The time limit is reset by releasing the manual trigger (if the trigger only starts the time limit), by release of the workpiece responsive trip (if the trip only starts the time limit), or by releasing both the manual trigger and the workpiece responsive trip (if either triggering means will initiate the time limit).

The time limit is reset each time the tool is fired by other means independently operated by the firing mechanism. This permits firing of the tool as long as one of the triggering means is in its firing position and the other of the triggering means is shifted to its firing position in rapid sequence separated by intervals shorter than the time limit interval.

In an instance where the manual trigger only initiates the time limit, protection would be achieved against damage or injury from unintentionally brushing the workpiece responsive trip against some object. In an instance where only the workpiece responsive trip initiates the time limit, protection would be gained against mislocated fasteners in the work during rest or idle periods. In the preferred embodiment wherein both triggering means can initiate the time limit, protection against both types of hazards can be achieved. In any embodiment, the time limit should be of such duration that the tool can only be fired unintentionally only with great difficulty.

SUMMARY OF THE INVENTION

The invention contemplates the provision of safety means in a fluid operated tool of the type having firing control means comprising two separate and independent triggering means, shiftable inependently between normal and firing positions and requiring both triggering means to be concurrently in their firing positions to actuate the tool. The safety means introduces into the firing sequence of the firing control means a time limit within which both triggering means must achieve their firing positions. If both triggering means do not achieve their firing positions within the time limit, a lock-out means is operated to prevent firing of the tool.

In a first exemplary embodiment to be described, the time limit imposed by the safety means of the present invention can be initiated by either the manual trigger or the workpiece responsive trip, whichever is shifted to its firing position first. The safety means is embodied in a unique valve assembly hereinafter indentified as the remote valve assembly for the pneumatic fastener applying tool and the lock-out means comprises a part of the remote valve assembly. The remote valve assembly has a trigger core shiftable by the triggering means and the functions of the safety means of the present invention are accomplished by the remote valve assembly and are actuated pneumatically. The invention also contemplates and exhaust valve assembly operated pneumatically by the firing mechanism for resetting the time limit, as described above. If the lock-out means is actuated, it can be returned to its normal position when both triggering means are concurrently in their normal positions.

In a second embodiment the time limit is initiated by only one of the triggering means and for purposes of an exemplary showing the manual trigger is taught as initiating the time limit. In this embodiment the safety means comprises the combination of a remote valve assembly, a separate valve assembly actuated by the manual trigger only and a timing valve assembly. A lock-out means similar to that of the first embodiment may be employed and if actuated can be returned to its normal position by return of the manual trigger to its normal position.

BRIEF DESCRIPTION OF THE DRAWINGS

FIGS. 2 through 7 are fragmentary cross sectional elevational views of the remote valve assembly of FIG. 1 and the portions of the tool housing supporting it, illustrating the various elements of the remote valve assembly in their various operating positions.

FIG. 9 is a cross sectional view similar to FIG. 8 illustrating the exhaust valve assembly in its open position.

FIG. 12 is a fragmentary, side elevational, cross sectional view of a tool similar to that of FIG. 1 provided with a variable air chamber for the safety means of the present invention.

FIG. 13 is a cross sectional view taken along the section line 13—13 of FIG. 12.

FIGS. 14 through 17 are fragmentary cross sectional elevational views (partially diagrammatic) of a second embodiment of the safety means of the present invention applicable to a tool of the type shown in FIG. 1 and illustrate the remote valve assembly, manual trigger operated valve assembly and timing valve assembly in their various operating conditions.

DESCRIPTION OF THE PREFERRED EMBODIMENTS

General

Figures 1, 10, 11:
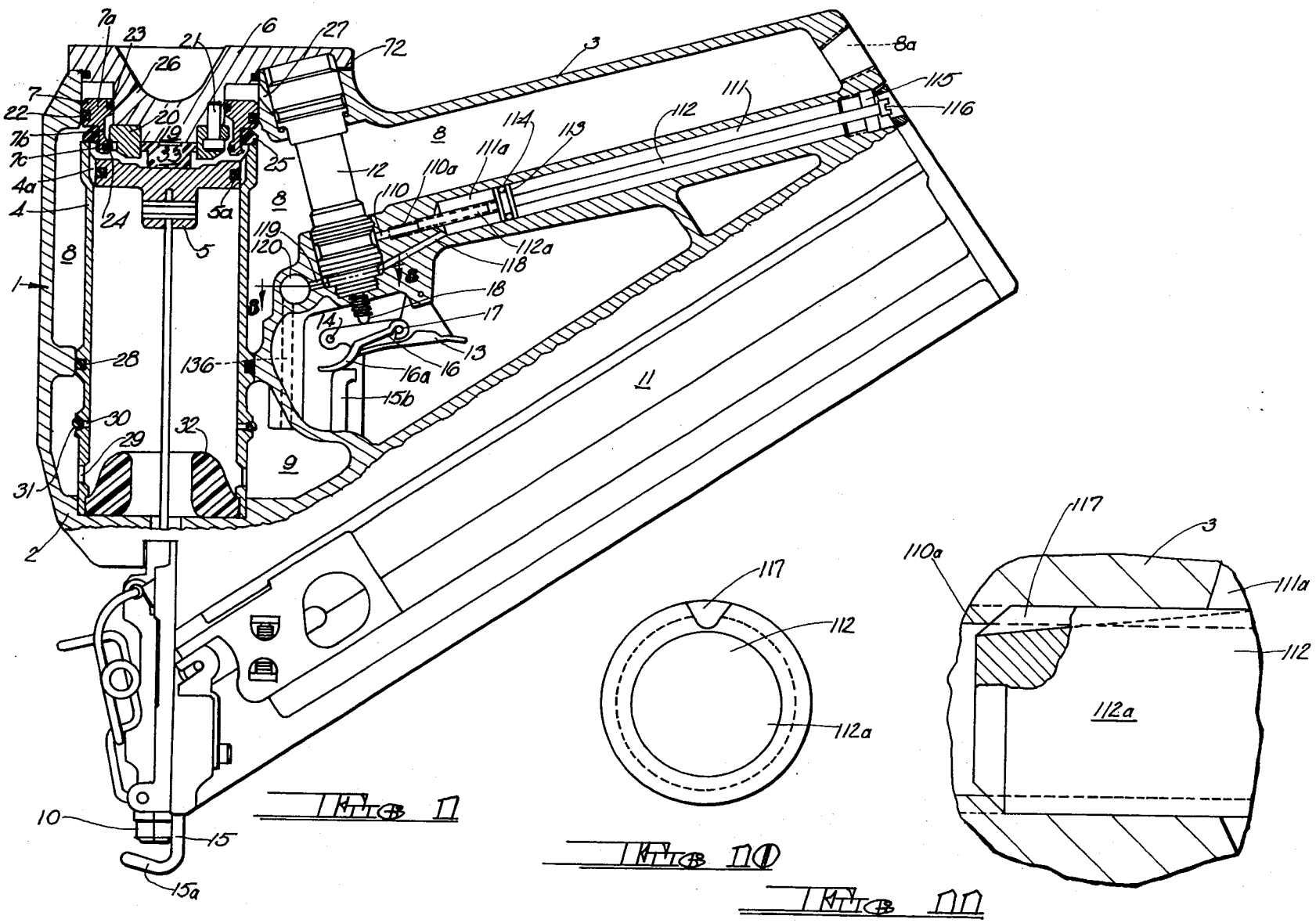
FIG. 1 is a side elevational view of an exemplary pneumatic fastener applying tool embodying one embodiment of the safety means of the present invention.
FIG. 10 is an end elevational view of the rod of FIG. 1 bearing the variable metering orifice of the present invention.
FIG. 11 is a fragmentary side elevational view of the end of the rod of FIG. 10.

For a better understanding of the safety means of the present invention reference is first made to FIG. 1 illustrating an exemplary pneumatic fastener driving tool embodying the safety means. The tool itself comprises a housing generally indicated at 1 and having a body portion 2 and a handle portion 3. The body portion 2 and the handle portion 3 of the housing are generally hollow. A working cylinder 4 is located within the body portion 2 and is provided with a piston and driver assembly 5.

The upper end of the housing body portion 2 is closed by a cap 6. Cap 6 supports a firing valve assembly 7 which, if opened, permits the piston and driver assembly 5 to be actuated by air under pressure within the air reservoir 8 surrounding the working cylinder 4 and extending into the housing handle portion 3. It will be understood that air reservior 8 will be connected to an appropriate source of air under pressure through a line (not shown) having a fitting (not shown) threadly engaged in the port at **8*a* at the rearward end of the housing handle portion 3.**

Beneath the housing body portion 2 the tool is provided with a nose piece generally indicated at 10. The nose piece has an internal passage or drive track into which fasteners (not shown) are successively delivered by the fastener magazine 11. A fastener in the drive track will be driven downwardly into a workpiece by the piston and driver assembly 5 when the firing valve assembly is opened, as subsequently described.

The firing valve assembly 7 is controlled by a remote valve assembly 12. The remote valve assembly 12, in turn, is controlled by a dual triggering means. To this end, a manual trigger is shown at 13 pivotally affixed to the housing at 14. A workpiece responsive triggering means is also illustrated, comprising a trip assembly 15 having a lower end 15a located slightly below the lowermost end of nose piece 10 of the tool and an upper portion **15*b* located slightly below the manual trigger 13. The workpiece responsive triggering means also includes a lever 16 pivoted at one end to the manual trigger as at 17 and having a free end 16*a* resting upon the upper end 15*b* of the trip assembly. It will be evident from FIG. 1 that if the manual trigger 13 is shifted upwardly to its firing position, lever 16 will contact the trigger core 18 of remote valve assembly 12, causing the trigger core 18 to be half stroked. Similarly, if the nose piece 10 is brought into contact with a workpiece, the trip 15 will shift upwardly to its firing position, causing upward movement of lever 16 to half stroke the trigger core 18. If both the manual trigger 13 and the trip 15 are shifted upwardly to their firing positions, the lever 16 will fully stroke trigger core 18**.

The cap 6 has a downwardly depending central portion 19. An annular ring-like member 20 is affixed thereto in any suitable manner, as by machine screws, one of which is shown at 21. It has an upper cylindrical outer surface and a lower portion with scallop-like recesses. The firing valve assembly 7 comprises an annular member adapted to shift vertically between the adjacent inner surface of housing body portion 2 and the downwardly depending portion 19 of cap 6 and the attached annular ring-like member 20. The firing valve assembly 7 has an upper enlarged portion *7a*, a downwardly depending skirt portion *7b* and a lower enlarged portion *7c*. The upper enlarged portion *7a* bears an O-ring 22 making a seal with the inside surface of the housing body portion 2. The upper enlarged portion also bears an O-ring 23 making a seal with a peripheral surface of the downwardly depending portion 19 of cap 6. The lower enlarged portion 7c of the firing valve assembly carries an O-ring 24 capable of sealingly engaging a peripheral surface of the annular ring-like member 20. Finally, the exterior surface of the skirt portion *7b* of the firing valve assembly carries a sealing ring 25. The sealing ring 25 is slidable on the skirt portion *7b* between the upper enlarged portion 7a and the lower enlarged portion *7c* of the firing valve assembly.

In FIG. 1, the firing valve assembly is illustrated in its closed position. In this position, O-ring 22 is in sealing contact with the inside surface of housing body portion 2, O-ring 23 is in sealing contact with its respective peripheral surface of portion 19 of cap 6 and O-ring 24 is out of sealing contact with the cylindrical upper portion of the annular ringlike member 20. Sealing ring 25 is shifted to its uppermost position on skirt portion *7b* of the firing valve assembly. At the same time, sealing ring 25 is in contact with the upper end of working cylinder 4 so as to close the cylinder with respect to air under pressure within reservoir 8.

It will be noted that the downwardly depending portion 19 of cap 6 has one or more passages 26 therethrough leading to atmosphere. Thus, when the firing valve assembly is in its closed position and its O-ring 24 is out of sealing contact with the annular ring-like member 20, that portion of working cylinder 4 above piston and driver assembly 5 is vented to the atmosphere through passages 26.

Remote valve assembly 12 is so constructed that when its trigger core 18 is unstroked or half stroked, air under pressure from reservoir 8 will be directed by the remote valve assembly through passage 27 in the housing to the space above the firing valve assembly 7. It will be obvious that, under these circumstances, air under pressure from reservoir 8 operates both above and below firing valve assembly 7. However, that area of firing valve assembly 7 operated upon by air under pressure coming through remote valve assembly 12 and passage 27 is greater than that area of the firing valve assembly exposed to air under pressure directly from reservoir 8, so that the firing valve assembly 7 is biased to its closed position so long as passage 27 is open the air under pressure from reservoir 8.

When the tool is actuated by its dual trigger mechanism and the parts of remote valve assembly 12 assume their firing positions, the air under pressure above firing valve assembly 7 will be vented to the atmosphere, as will be described hereinafter. Under these circumstances, air under pressure operating on the firing valve assembly directly from reservoir 8 can now cause the firing valve assembly to shift upwardly. This same air will initially tend to maintain sealing ring 25 seated against the upper end of working cylinder 4 while firing valve assembly 7 shifts upwardly. As a result, O-ring 24 of the firing valve assembly will come into sealing contact with the cylindrical upper portion of the annular ring-like member 20 thereby sealing off vent passage 26 prior to the opening of working cylinder 4. Additional upward movement of the firing valve assembly will result in a lifting of sealing ring 25 from the upper end of working cylinder 4 by the enlarged portion *7c* of the firing valve assembly.

Once the vent passage 26 has been closed and thereafter the sealing ring 25 has been lifted from the upper end of working cylinder 4, the piston and driver assembly 5 is exposed to air under pressure from reservoir 8 and is driven rapidly and with considerable force downwardly to drive the fastener within the drive track of nose 10 into a workpiece.

It will be noted that working cylinder 4 is provided with an O-ring 28 making sealing contact with the inside surface of housing body portion 2. This seal divides the hollow housing body portion into the upper reservoir 8 and a lower air return reservoir 9. When the piston and driver assembly 5 are in their upper or retracted position, the interior of working cylinder 4 below the piston and driver assembly is vented to atmosphere through the drive track and through small recesses 4a in the walls of cylinder 4. The same is true of air return reservoir 9 by virtue of the plurality of radial ports 29 near the bottom of working cylinder 4. Finally, as shown in FIG. 1, the working cylinder 4 is provided within the air return reservoir 9 with a plurality of small radial ports 30 normally closed by an O-ring 31 which serves as a check valve, which allows flow through ports 30 only from working cylinder 4 to the air return reservoir 9.

When the firing valve assembly 7 is opened and air under pressure from reservoir 8 is free to operate on the upper surface of piston and driver assembly 5, air beneath the piston will be discharged through the drive track to atmosphere or compressed slightly and caused to flow to return reservoir 9 through ports 29. The lowermost driven position of piston and driver assembly 5 is determined by a resilient bumper 32 and is such that the upper surface of the piston will lie immediately below radial ports 30. Thus, once the piston has achieved its driven position, air under pressure from reservoir 8 may enter air return reservoir 9 via radial ports 30 and the check valve formed by O-ring 31. The venting to atmosphere through the drive track is effectively closed off by the piston and driver assembly 5 sealing against the upper surface of bumper 32.

Upon release of one or both of the triggering means, the elements of the remote valve assembly 12 will be returned either to their half stroked or their unfired position as will be described hereinafter. This will permit the flow of air under pressure from reservoir 8 through passage 27 in the housing body to the upper surface of firing valve assembly 7. As explained earlier, the greater effective surface area of the upper portion of the firing valve assembly 7 will result in its downward movement. Sealing ring 25 being in its lowermost position with respect to the firing valve assembly 7 will first contact the upper edge of working cylinder 4 closing the cylinder. Further downward movement of the firing valve assembly 7 will cause O-ring 24 thereof to release its sealing engagement with the upper cylindrical outer surface of annular ring-like member 20 thus venting that portion of working cylinder 4 above the piston and driver assembly 5 to atmosphere through vent passage 26 in cap 6. Air under pressure in air return reservoir 9 is now free to act through ports 29 to lift the piston and driver assembly 5 off of resilient bumper 32. This immediately exposes the full area of the underside of the piston to the air under pressure within air return reservoir 9 resulting in an upward "kick" of the piston and driver assembly 5 to its uppermost position. Immediately after this initial "kick" the air pressure within air return reservoir 9 will be vented to atmosphere through the drive track softening the upward movement of the piston and driving assembly 5. The remainder of the compressed air retained in air return reservoir 9 after the piston and driver assembly 5 reaches its topmost position is also vented through small grooves 4*a* past the O-ring 5*a* at the top of the piston and driver assembly through passage 26 to atmosphere. Any appropriate means, such as a detent in the nose piece 10 (not shown), may be used to maintain the piston and driver assembly 5 in its uppermost position. A resilient bumper 33 softens the impact of the piston and driver assembly 5 on the cap 6.

REMOTE VALVE ASSEMBLY — GENERAL

The basic parts and operation of the tool of FIG. 1 having been described, reference is now made to FIG. 2 for a description of the remote valve assembly 12 and its associated parts. It will be noted from FIG. 1 that the remote valve assembly 12 is mounted in the tool housing 1 essentially at the juncture of the housing body portion 2 and the housing handle portion 3, and extends through the reservoir 8. In FIG. 2, upper and lower fragmentary parts of the housing handle portion 3 are shown together with a fragmentary part of cap 6. The remote valve assembly 12 is made up of five basic parts comprising the valve housing 34, the remote cage 35, the trigger core housing 36, the previously mentioned trigger core 18 and the remote core 37.

The lower portion of the tool housing handle portion 3 is provided with three concentric bores 38, 39 and 40 of decreasing diameter, respectively. The upper housing handle portion 3, illustrated in FIG. 2, is provided with bores 41 and 42. These bores are concentric with each other and with bores 38, 39 and 40, the bore 42 being of lesser diameter than bore 41.

THE VALVE HOUSING

The lower end of the valve housing 34 is received within bore 38 with a sliding fit. The lowermost end of the valve housing 34 is provided with a plurality of radial notches 43. The lower portion of the valve housing 34 has two annular exterior bosses 44 and 45 thereon separated by a portion of reduced diameter containing a plurality of radial ports 46. For the sake of simplicity, the word "boss" is used throughout the specification to define and annular portion of larger diameter than adjacent portions of a valve element. The bosses 44 and 45 are of substantially the same diameter as the diameter of bore 38 and carry O-rings 47 and 48, respectively, in sealing engagement with the wall of bore 38. Immediately above boss 45, the valve housing 34 is provided with a plurality of lower radial bores 49. Thereabove, the housing has an elongated portion 50 of reduced diameter, the upper part of which is provided with a plurality of intermediate radial bores 51. Thereabove, the valve housing 34 is provided with annular exterior bosses 52 and 53 carrying O-rings 54 and 55 respectively. The bosses 52 and 53 are separated by a portion of reduced diameter containing a plurality of upper radial bores 56. Finally, the uppermost portion of the valve housing 34 has a plurality of radial notches 57.

Internally, the valve housing 34 is provided with bores 58, 59 and 60 of decreasing diameter. At the area of the uppermost radial notches 57, the valve housing 34 is provided with a bore 61 of a diameter slightly greater than the bore 60.

THE REMOTE CAGE

The remote cage 35 is a generally cylindrical member provided with annular exterior bosses 62 and 63 having a diameter substantially equivalent to that of the bore 41 in the housing handle portion 3. Boss 62 carries an O-ring 64 making a sealing engagement with the wall of bore 41. Below boss 63, the remote cage has a portion 65 having an external diameter substantially equivalent to the internal diameter of bore 42 in the upper housing handle portion 3. An O-ring 66 forms a seal between the shoulder formed between boss 63 and portion 65 on the remote cage and the shoulder formed between bores 41 and 42 in the upper housing handle portion 3.

Internally, the remote cage 35 has a lower bore 67 adapted to be in sealing engagement with O-ring 54 of the valve housing 34, an intermediate bore 68 of greater diameter and having a plurality of radial ports 69 and an upper bore 70 adapted to be sealingly engaged by O-ring 55 of the valve housing 34. The uppermost portion of the remote cage 35 is of reduced wall thickness and has a plurality of radial ports 71. It will be noted from FIG. 2 that the remote cage 35 is fixedly located within bores 41 and 42 of the upper housing handle portion 3 and is held in place by the tool cap 6. It will further be noted that an exhaust port 72 is provided between the upper housing handle portion 3 and the cap 6, the exhaust port 72 leading to atmosphere.

THE TRIGGER CORE HOUSING

The upper part of trigger core housing 35 has an external diameter substantially equivalent to the internal diameter of bore 59 of the valve housing 34. The middle part of trigger core housing 36 has an external diameter substantially equivalent to bore 58. A first external boss at 73 at the lowermost end of the trigger core housing carries an O-ring 74 adapted to sealingly engage the wall of bore 39 in the lower housing handle portion 3. A second boss 75 carries an O-ring 76 adapted to sealingly engage bore 58 of the valve housing 34. A third boss 77 carries an O-ring 78, again adapted to sealingly engage bore 58 of valve housing 34. Finally, the uppermost portion of the trigger core housing carries an O-ring 79 adapted to sealingly engage the bore 59 of valve housing 34.

The trigger core housing 36 is hollow to slidingly receive the trigger core 18. The trigger core housing has first, second and third areas of reduced internal diameter providing surfaces 80, 81 and 82 and a fourth area of even further reduced internal diameter providing a surface 83. The purposes of these surfaces of reduced diameter will be evident hereinafter. In addition, the trigger core housing 36 is provided with a plurality of large radial ports 84 and a plurality of small radial ports 85. Finally, the trigger core housing 36 has an annular notch 86 at its lower end, the purpose of which will be evident hereinafter.

THE TRIGGER CORE

The trigger core 18 comprises an elongated member having a lowermost nose portion 87 terminating in a rounded end 88. The trigger core has a first boss 89 bearing an O-ring 90 sealingly engageable with the interior surface 80 of the trigger core housing 36. A second boss is shown at 91 mounting an O-ring 82 sealingly engageable with the interior surface 81 of the trigger core housing 36. A third boss is shown at 93 having an O-ring 94 sealingly engageable with interior surface 82 of the trigger core housing 36. At its uppermost end, the trigger core has a boss 95 bearing O-ring 96, sealingly engageable with interior surface 83 of the trigger core housing. The trigger core 18 is provided with an axial bore 97 terminating in a transverse bore 98 between bosses 89 and 91. The purpose of bores 97 and 98 be described hereinafter.

The trigger core 18 is adapted to be vertically shiftable within trigger core housing 36. The trigger core 18 will be normally biased to its lowermost position (as shown in FIG. 2) by air under pressure from air reservoir 8 as hereinafter described. In addition, the trigger core may, for safety purposes, be additionally biased to its lowermost position by compression spring 99. The lowermost end of compression spring 99 abuts a retaining ring 100 captively held on the trigger core nose 87. The uppermost end of compression spring 99 abuts a ring 101 located within the notch 86 in the trigger core housing and against the shoulder formed between bores 39 and 40 in the lower housing handle portion 3. Ring 101 has axial notches 101a about its inner surface, the purpose of which will be set forth hereinafter.

THE REMOTE CORE

The final part of remote valve assembly 12 is the remote core 37. The remote core 37 comprises an elongated member having a lowermost boss 102 bearing O-ring 103 adapted to sealingly engage the interior surface 59 of the valve housing. An intermediate boss 104 bearing an O-ring 105 is located on the remote core 37, the O-ring 105 adapted to sealingly engage the interior surface 60 of valve housing 34. An uppermost boss 106 carries an O-ring 107 adapted to sealingly engage the same interior surface 60 of valve housing 34.

At its uppermost end, the remote core terminates in a nose 108. The nose 108 acts as a guide for compression spring 109. Compression spring 109 abuts at its lowermost end the remote core boss 106. At its uppermost end the compression spring 109 abuts the interior surface of the can 6 of the tool. The compression spring 109 is intended to assume biasing of the remote core to its lowermost position illustrated in FIG. 2. As will be described hereinafter, the remote core will normally be biased to its lowermost position by air under pressure from reservoir 8.

AUXILIARY RESERVOIR

Referring to FIGS. 1 and 2, it will be noted that a bore or passage 110 is located in the lower part of the housing handle portion 3. The passage 110 is coaxial with a bore 111 extending to the rearwardmost part of the tool. A portion 110a of passage 110 is threaded.

FIG. 1 further illustrates a shaft 112. The shaft 112 bears a piston 113 having an O-ring 114. The forwardmost end of the shaft 112, shown at 112*a*, is threaded and is adapted to be threadedly engaged in the threaded portion 110a of passage 110. The rearward end of shaft 112 is rotatively received in a fitting 115 threadedly engaged in the rearward end of bore 111. The rearward end of the shaft is provided with a slot 116 by which the shaft may be turned. In this manner, more or less of the threaded portion 112*a* of shaft 112 may be engaged in the threaded portion 110*a* of passage 110. That portion 111*a* of bore 111, ahead of piston 113, constitutes a auxiliary reservoir, the purpose of which will be described hereinafter.

FIG. 10 is an elevational view of the forward threaded end 112a of shaft 112. FIG. 11 illustrates this forward portion 112a engaged in the threaded portion 110*a* of the passage 110. It will be noted from FIGS. 10 and 11 that the forwardmost end of shaft portion 112a is provided with a notch 117 which diminishes in depth as it extends rearwardly of shaft portion 112*a*. It will be evident from FIGS. 1, 10 and 11 that as shaft 112 is so rotated as to cause the forward shaft portion 112*a* to shift outwardly of threaded passage 110*a*, the cross section of that portion of notch 117 exposed at the forward end of reservoir 111*a* will be greater. Similarly, as shaft 112 is rotated so as to cause its forward end 112*a* to penetrate deeper into threaded passage 110*a*, the cross section of notch 117 at the forward end of reservoir 111a will diminish. Thus, notch 117 constitutes a variable metering orifice between passage 110 and reservoir 111*a*. Reservoir 111*a* is connected to the lowermost portion of bore 38 (receiving the lower portion of remote valve assembly 12) by passage 118.

EXHAUST VALVE

Figures 8A, 8B, 8C, 8D:
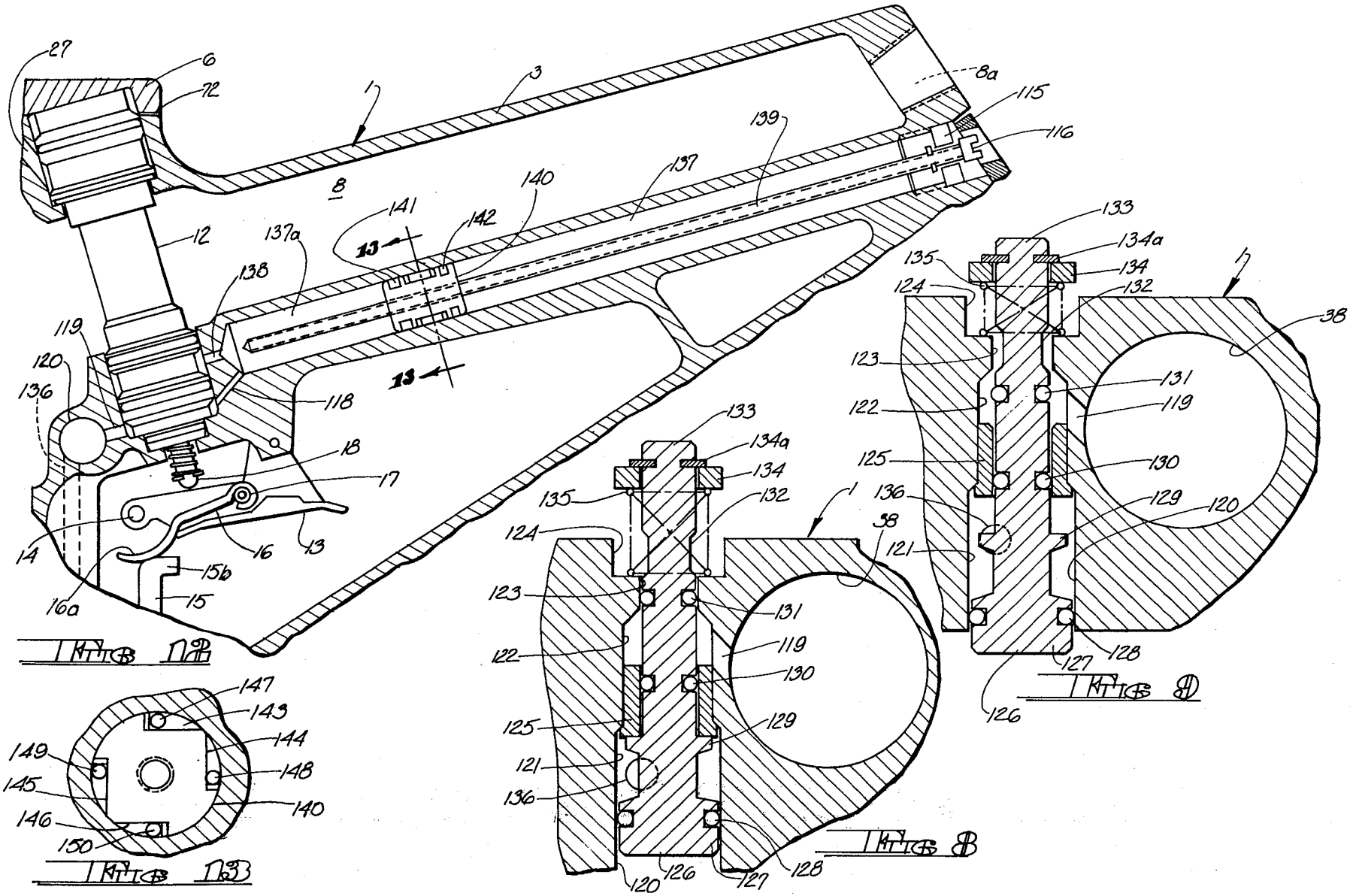
FIG. 8 is a cross sectional view taken along the section line 8—8 of FIG. 1 and illustrating the exhaust valve assembly in its closed position.

To complete the structure, it will be evident from FIGS. 1, 2 and 8 that the lowermost portion of bore 38 is also connected by a passage 119 leading to a bore 120 containing an exhaust valve 126. Exhaust valve 126 is clearly shown in FIG. 8.

Bore 120 passes through the housing 1 of the tool at the juncture of housing body portion 2 and housing handle portion 3. Bore 120 has a first portion of large diameter 121, a second portion of intermediate diameter 122 and a third portion of small diameter 123. The portion 123 terminates in a circular depression 124 in the exterior surface of the tool housing. A valve guide and stop means 125 is fixed in bore portion 122.

The exhaust valve 126 comprises an elongated stem having an enlarged rearward end 127 carrying an O-ring 128 adapted to sealingly engage bore portion 121. The stem also carries an annular stop 129 adapted to cooperate with the valve guide and stop means 125. An O-ring 130 is located on the stem to sealingly engage valve guide and stop means 125. Yet another O-ring 131 is sealingly engageable with bore portion 123.

Ahead of O-ring 131 the exhaust valve stem has an annular notch 132 of reduced diameter followed by a nose portion 133. The nose portion 133 carries a collar 134 and retaining ring 134a. The collar 134 serves as the seat for one end of a compression spring 135. The other end of spring 135 seats in the circular depression 124 in the surface of the tool body 1. Spring 135 tends to maintain exhaust valve 126 in its closed position as shown in FIG. 8. Finally, it will be noted that bore portion 121 is intersected by a passage 136 leading to the air return reservoir 9 (see FIG. 1).

OPERATION

The remote valve assembly 12, reservoir 111 and exhaust valve 126 having been described, the operation of the safety means of the present invention may now be set forth, referring first to FIGS. 1 and 2. These figures illustrate the operative parts of the fastener applying tool in their normal or unfired condition. While the valve housing 34 is free to shift vertically, it will be evident from FIG. 2 that the exterior boss 45 and the exterior shoulder immediately thereabove will present more area than the boss 52 to the air under pressure in surrounding reservoir 8, with the result that the valve housing is biased downwardly to its normal position shown in FIG. 2.

Air under pressure from surrounding reservoir 8 will pass through the intermediate radial ports 51 in the valve housing 34. Since the lower boss 102 of remote core 37 presents more area than the upper boss 106, this air under pressure will bias the remote core to its lowermost normal position shown in FIG. 2. Safety spring 109 will assure that the remote core 37 will normally be positioned as shown in FIG. 2. The air under pressure entering radial intermediate ports 51 is free to pass through the radial upper ports 56 in the valve housing 34, the radial ports 69 in the remote cage 35 and through passage 27 to the space above the firing valve assembly 7. Thus, the firing valve assembly 7 will be held in its closed position. O-ring 107 on the remote core, O-ring 55 on the valve housing 34 and O-ring 64 on the remote cage will prevent any air from passing through vent passage 72 to atmosphere.

Air under pressure from surrounding reservoir 8 is also free to pass through the lower radial ports 49 in the valve housing 34 and the radial ports 84 in the trigger core housing 36. This air, however, cannot pass between the trigger core housing and the valve housing 34 by virtue of O-rings 78 and 79 carried by the trigger core housing 36. Similarly, this air cannot pass between the trigger core 18 and the trigger core housing 36 by virtue of O-rings 94 and 96 carried by the trigger core 18. Trigger core housing 36 is held in its position by friction between O-ring 74 and bore 39 of housing 1 and by the downward bias created by the air pressure acting on the area difference between boss 77 and O-ring 79 of the trigger core housing 36. Since boss 93 on the trigger core 18 presents a greater area than boss 95, the air passing through trigger core housing ports 84 will tend to bias trigger core 18 to its lowermost position. This is assisted by compression spring 99.

In summary, when both the workpiece responsive trip member 15 and the manual trigger 13 are in their normal positions, the trigger core 18 of remote valve 12 will be biased to its lowermost position. Remote core 37 will be biased to its lowermost position, as will be the valve housing 34. The remote valve assembly 12 will permit air to freely pass from surrounding reservoir 8, through passage 27 to the space above firing valve assembly 7, maintaining firing valve assembly 7 closed. It will further be noted from FIG. 2 that the sapce between the trigger core 18 and the remote core 37 of remote valve assembly 12 will be vented to atmosphere via axial passage 97 and transverse passage 98 in the trigger core 18. Since trigger core O-ring 90 is not in sealing contact with the inner surface 80 of trigger core housing 36, the transverse passage 98 leads to atmosphere through axial notches 101*a* in retaining ring 101 which not only serves as an abutment for compression spring 99, but also determines the lowermost position of trigger core 18 by virtue of its being abutted by trigger core boss 89.

FIG. 3 illustrates remote valve assembly 12 with its trigger core 18 half-stroked. It will be remembered that this occurs when one of the triggering means 15 or 13 is shifted to its firing position, while the other remains in its normal position.

When the trigger core 18 is half stroked, the only change in the position of the valve parts occurs with respect to the trigger core 18, itself, which is shifted part-way upwardly. The upper portion of remote valve assembly 12 operates in the same manner described with respect to FIG. 1, air from reservoir 8 being free to pass through passage 27 to the space above firing valve assembly 7, holding the firing valve assembly closed. This air is prevented from passing through vent passage 72 and at the same time biases remote core 37 to its lowermost position. In the lower portion of remote valve assembly 12, the space between the trigger core 18 and the remote core 37 remains vented to the atmosphere as described above.

However, with the trigger core 18 half stroked, it will be noted that air passing through the lower radial ports 49 in the valve housing 34 and through the radial ports 84 in the trigger core housing 36 is now free to pass by O-ring 94 on the trigger core to the area between O-ring 94 and O-ring 92 of the trigger core. This air passes through radial ports 85 in trigger core housing and through radial ports 46 in the valve housing 34. Air from ports 46 is free to pass through passage 110 and through metering groove 117 in the shaft 112 shown in FIGS. 10 and 11 to the reservoir 111*a*. Air from reservoir 111*a* is free to pass, in turn, through passage 118 and through the notches 43 at the lowermost end of the valve housing 34 to that area inside the valve housing defined by the trigger core housing 36 and its O-rings 74 and 76. This same air can also pass through passage 119 to that portion of the bore 120 defined by exhaust valve 126 and its O-rings 130 and 131 shown in FIG. 8. The air is effectively stopped at this point.

Once air can begin to enter safety reservoir 111*a* through metering orifice or notch 117, the safety time limit has been initiated, as will be described hereinafter.

For purposes of this explanation, it will first be assumed that the second of the two independent triggering means has been actuated within the safety time limit. To this end, FIG. 4 illustrates that instantaneous condition of remote valve assembly 12 immediately after the trigger core 18 has been fully stroked and before the firing of the tool. In this instantaneous condition, it will be noted that air from surrounding reservoir 8 is still permitted to enter passage 27 to that space above the firing valve assembly 7 and is still prevented from being vented to atmosphere through vent passage 72. Furthermore, air entering lower radial passages 49 in valve housing 34 is still permitted to enter into passage 110 and pass through metering orifice or notch 117 to reservoir 111*a*.

In this instantaneous condition illustrated in FIG. 4, the trigger core 18 has moved to its uppermost position. Now, O-ring 90 of the trigger core makes sealing contact with the interior surface 80 of trigger core housing 36 and the axial passage 97 and transverse passage 98 are no longer connected to atmosphere. Air from surrounding reservoir 8 entering the lower radial passages 49 of valve housing 34 and radial ports 84 of trigger core housing 36 is free to flow past O-ring 96, which is no longer engaged with surface 83 and then to act upon the underside of remote trigger core 37. This, in conjunction with air entering intermediate ports 51 in the valve housing 34 and acting upon the upper boss 106 of the remote core will cause remote core 37 to shift upwardly against the action of spring 109.

FIG. 5 illustrates remote valve assembly 12 fully triggered and with the remote core 37 in its uppermost position. It will be immediately evident from FIG. 5 that air from surrounding reservoir 8 is no longer free to pass through passage 27 to the upper part of the firing valve assembly 7. Air entering intermediate radial bores 51 in valve housing 34 is effectively blocked by O-rings 103 and 105 on remote core 37. However, O-ring 107 at the uppermost part of remote core 37 is no longer in sealing engagement with the interior surface 60 of the valve housing 34 with the result that the space above the firing valve assembly 7 is vented to the atmosphere through passage 27, radial ports 69 in the remote cage 35, upper radial ports 56 and radial notches 57 in the valve housing 34, radial ports 71 in the uppermost portion of remote cage 35 and vent passage 72. As explained above, once pressure is relieved above firing valve assembly 7, the valve will open and the piston and driver assembly will drive a fastening element into the workpiece. It is important to note that O-ring 105 on remote core 37 will sealingly engage interior surface 60 of the valve housing 34 prior to the disengagement of remote core O-ring 107 with the same surface assuring that air from reservoir 8 will not be vented to atmosphere via vent passage 72.

Turning to FIGS. 1, 8 and 9, it will be remembered that immediately following the arrival of piston and driver assembly 5 in its lowermost position, air pressure is built up within air return reservoir 9. This air pressure will also exist in passage 136 and will operate upon boss 127 and O-ring 130 of exhaust valve 126. Boss 127 is larger than O-ring 130 so that the air pressure causes the exhaust valve 126 to move to its open position illustrated in FIG. 9. As a result, O-ring 131 on exhaust valve 126 is shifted away from sealing engagement with the portion 123 of bore 120 so that any air which has built up in reservoir 111*a* will now be vented to atmosphere through passages 119, 118 and the lowermost portion of bore 38 in housing 1. This, as explained above, resets the time limit of the safety device of the present invention to zero. Upon return of both manual trigger 13 and workpiece responsive trip 15 to their normal positions, the remote valve assembly 12 will return to its unfired condition as shown in FIG. 2 and described with respect thereto. Alternatively, if only one of the independent triggering means is returned to its normal position, remote valve assembly 12 will return to the condition illustrated in FIG. 3 wherein the trigger core 18 is half stroked. Since, in this condition, air is free to pass through metering notch or orifice 117 to reservoir 111*a*, it will be understood that the time limit of the present invention will be immediately reinitiated. If the remaining triggering mechanism is shifted from its normal to its fired position within the required time limit, the tool will fire and remote valve assembly 12 will assume the various conditions described hereinabove with respect to FIGS. 4 and 5.

As indicated above, once the trigger core 18 is half stroked (as described with respect to FIG. 3) the time limit of the present invention will be initiated. Having described the operation of remote valve assembly 12 when both trigger mechanisms are shifted to their firing positions within the time limit, reference is now made to FIG. 6 to show how the tool is disabled by a lock-out means when trigger core 18 is half stroked by one of the independent triggering means 13 and 15 and the second of the independent triggering means is not shifted to its firing position within the time limit.

Returning to FIG. 3, it will be remembered that when trigger core 18 is half stroked, air from surrounding reservoir 8 may pass through radial lower ports 49 of the valve housing 34, radial ports 84 of the trigger core housing 36, radial ports 85 of the trigger core housing and radial ports 46 of the valve housing 34 to passage 110, metering orifice or notch 117 and reservoir 111*a*. From the reservoir 111*a* air under pressure may also pass through passage 118 to the area beneath the valve housing 34 and thence through passage 119 to that portion of the exhaust valve bore 120 sealed by O-rings 130 and 131 on the exhaust valve 126. Since there is no place for the air under pressure in safety reservoir 111*a* to be vented to the atmosphere, the air pressure in this chamber and beneath the valve housing 34 will build up to that air pressure within reservoir 8 at a rate determined by the variable metering orifice or notch 117. The pressure build up rate determined by variable metering orifice 117 constitutes the duration of the time limit of the present invention. When the air pressure has built up to the point where it approaches the air pressure in reservoir 8 the time limit expires. It will be understood that this air pressure will exist at the bottom end of valve housing 34. This air pressure at the bottom of valve housing 34 and air pressure directly from reservoir 8 acting upon exterior boss 52 of the valve housing will counteract the normal downwardly biasing pressure on the valve housing and cause the valve housing to shift upwardly as shown in FIG. 6.

It will be evident from FIG. 6 that air from surrounding reservoir 8 may pass through intermediate radial ports 51 of valve housing 34, the upper radial ports 56 of the valve housing and the radial ports 69 of remote cage 35 and thence through passage 27 to the space above the firing valve assembly, effectively preventing the opening of that valve assembly and the firing of the tool. O-ring 64 of remote cage 35, the uppermost O-ring 55 of valve housing 34 and the uppermost O-ring 107 of the remote core will prevent any venting of air from surrounding reservoir 8 through vent passage 72 to atmosphere. Similarly, O-ring 92 on trigger core 18 will prevent any venting of the air in reservoir 111*a* to atmosphere past the nose of the trigger core. Thus, when valve housing 34 shifts upwardly, it serves as a lock-out means to prevent the firing of the tool.

The latter statement is true even if, after the time limit has expired and the valve housing 34 has shifted upwardly, the remaining independent trigger means is shifted to its firing position. This is illustrated in FIG. 7. FIG. 7 is similar to FIG. 6, but it will be noted that with both independent triggering means shifted to their firing position the trigger core 18 has been fully stroked. Air from surrounding reservoir 8 passing through the lower radial ports 49 of the valve housing 34 and the radial ports 84 of the trigger core housing can now pass by the uppermost O-ring 96 on the trigger core to the lowermost surface of remote core 37. This, as in the case of FIG. 5, will cause the remote core 37 to shift upwardly to its uppermost position. However, since the valve housing 34 has previously shifted upwardly, the uppermost O-ring 107 on the remote core still sealingly engages the interior surface 60 of the valve housing 34 preventing venting of pressurized air from reservoir 8 through vent passage 72. The air from reservoir 8 is still conducted through passage 27 to the upper part of the firing valve assembly 7, preventing its opening and thereby preventing firing of the tool.

O-ring 92 on trigger core 18 still prevents venting of the air under pressure in reservoir 111*a* past the nose of the trigger core 18. The lowermost O-ring 90 on the trigger core also is in sealing engagement with interior surface 80 of trigger core housing 36, preventing venting of air through axial and transverse passages 97 and 98 in the trigger core, past the trigger core nose.

It will be evident from FIGS. 6 and 7 that once the time limit has been exceeded and the air pressure within reservoir 111*a* has reached the point where the valve housing 34 has shifted upwardly, the valve housing acts as a lock-out irrespective of the position of the remote core 37 and when the trigger core 18 is either half stroked or fully stroked. If the trigger core is fully stroked as shown in FIG. 7 and is thereafter returned to its half stroked position by return of one of the independent triggering means to its normal position, the area beneath remote core 37 will be vented to the atmosphere through axial and transverse passages 97 and 98 in the trigger core and past the trigger core nose, resulting in the return of remote core 37 to its lowermost position as illustrated in FIG. 6. Nevertheless, as described with respect to FIG. 6, the air pressure holding the valve housing 34 in its uppermost position cannot vent to atmosphere and the tool will remain disabled.

When the time limit imposed by the safety means of the present invention has been exceeded and the valve housing 34 has shifted upwardly to serve in its role as a lock-out means to prevent firing of the fastener applying tool, the valve housing 34 can only be returned to its normal lower position by returning both independent trigger mechanisms (the workpiece responsive trip 15 and the manual trigger 13) to their normal positions. When this occurs, the trigger core 18 will assume its lowermost position as illustrated in FIG. 2, being biased to its lowermost position by air under pressure from reservoir 8. O-ring 94 on the trigger core will sealingly engage the interior surface 82 of the trigger core housing 36 preventing further passage of air under pressure to reservoir 111*a*. At the same time, both O-rings 90 and 92 on the trigger core will shift out of sealing engagement with their respective interior surfaces 80 and 81 of the trigger core housing 36. This will enable the air under pressure beneath the valve housing 34 and within the reservoir 111*a* to vent to atmosphere through radial ports 46 in valve housing 34, radial ports 85 in the trigger core housing and along and past the nose of trigger core 18. As explained with respect to FIG. 2, the valve housing 34 is normally biased downwardly by air under pressure within surrounding reservoir 8 and as soon as the air pressure is relieved beneath the valve housing 34, it will return to its position shown in FIG. 2. When this occurs, all of the parts of remote valve assembly 12 will assume their positions illustrated in FIG. 2, i.e. their unfired positions. At this point, the firing sequence and the time limit imposed by the safety means of the present invention can be reinitiated.

ALTERNATE ADJUSTMENT OF TIME LIMIT

As indicated above, the length of the time limit imposed by the safety means of the present invention will depend upon the nature of the tool and its application. The time limit should be such that the tool under reasonable conditions can only be fired intentionally. With respect to FIGS. 1, 10 and 11 variable orifice means 117 have been described whereby the duration of the time limit can be appropriately adjusted. FIGS. 12 and 13 illustrate another means of providing an adjustable time limit. FIG. 12 illustrates a tool substantially identical to that of FIG. 1 and like parts have been given like index numerals. In this figure, the bore 137 is substantially the same as bore 111 of FIG. 1. The passage 138, coaxial with bore 137, is substantially identical to passage 110 of FIG. 1 but has no threaded portion. The bore 137 is closed at the rearward end of the tool by the fitting 115, as in the embodiment of FIG. 1. The fitting 115 rotatively supports one end of a shaft 139. Shaft 139 is similar to shaft 112 of FIG. 1 and is provided at its rearwardmost end with a slot 116 adapted to be engaged by an appropriate tool whereby the shaft may be rotated. Shaft 139 is threaded throughout its length. A piston 140 is threadedly engaged on shaft 139 and carries a pair of O-rings 141 and 142 adapted to sealingly engage the interior surface of bore 137.

FIG. 13 is a cross sectional view of piston 140 at its longitudinal center. The piston is provided with a first pair of oppositely oriented notches 143 and 144 and a second pair of oppositely oriented notches 145 and 146. Each of the notches 143 through 146 carries a roller shown at 147 through 150, respectively. Rollers 147 through 150 cooperate with their respective notches to prevent rotation of piston 140 within bore 137. Thus, if the piston tends to rotate in a clockwise direction (as viewed in FIG. 13) rollers 148 and 149 will tend to shift in their respective notches 144 and 145 producing a wedging action with the interior surface of bore 137 preventing such rotation. Similarly, if the piston tends to rotate in a counterclockwise direction, rollers 147 and 150 will shift in their respective notches 143 and 146 setting up a similar wedging action with the interior surface of bore 137 preventing such rotation. Since piston 140 is non-rotatable with respect to bore 137, a turning of shaft 139 in one direction will tend to cause the piston to shift toward the rear of the tool, while a turning of shaft 139 in the opposite direction will tend to cause the piston to shift in a direction towards remote valve assembly 12. That portion of bore 137 between the piston 140 and passage 138 (designated 137*a*) serves as a reservoir equivalent to reservoir 111*a* of FIG. 1. The reservoir 137 differs from that of FIG. 1 in that its size is variable, by varying the position of piston 140.

In the embodiment of FIG. 12, the ports 85 in trigger core housing 36 and the ports 46 in valve housing 34 (see FIG. 2) of remote valve assembly 12 will be of such number and so sized as to provide a reasonable flow of air into reservoir 137*a* upon initiation of the time limit by half stroking trigger core 18. The duration of the time limit may be varied by varying the size of the reservoir 137*a*.

It would be possible to provide the fastener applying tool with a preset, predetermined and invariable time limit. To this end, radial ports 85 in trigger core housing 36 may be so sized as to constitute preset metering orifices, or only a single port 85 may be provided in the trigger core housing, constituting a predetermined metering orifice. Alternatively, radial orifices 46 in the valve housing 34 could be so sized as to constitute metering orifices, or may be reduced in number to a single port constituting a predetermined metering orifice. At the same time, a predetermined and invariable auxiliary reservoir may be provided in the handle portion 3 of the housing.

Furthermore, in an instance where one or more of ports 85 in trigger housing 36 or one or more of ports 46 in valve housing 34 are used as a metering orifice, a separate reservoir in the lower handle portion 3 could be eliminated. In such an instance, lower boss 44 and the O-ring 47 it supports on the valve housing 34 would be eliminated. As a consequence, the space about the lower portion of the valve housing 34 and between the exterior of the valve housing and the bore 38 in the tool housing could, in and of itself, constitute the auxiliary reservoir of the present invention.

In the previously described embodiment of the present invention the time limit is initiated by that one of the manual trigger and the workpiece responsive trip which is shifted to its firing position first. If the other of the triggering means is not actuated within the time limit, the lock-out means is activated and both triggering means must be returned to their normal positions to release the lock-out means.

FIGS. 14 through 17 illustrate another embodiment of the safety means of the present invention wherein the time limit is initiated by only a preselected one of the triggering means and the lock-out means, if actuated, is released upon the return of that preselected triggering means to its normal position. As will be evident to one skilled in the art, the fastener driving tool may be so designed that either the workpiece responsive trip or the manual trigger may constitute the preselcted triggering means initiating the time limit. Since it constitutes the preferred embodiment, the tool will be described with the manual trigger constituting the preselected, time limit initiating triggering means.

This second embodiment of the safety means of the present invention may be applied to a tool substantially identical to that illustrated in FIG. 1. As a consequence, like parts have been given like index numerals. Turning first to FIG. 14 the tool has a body 1 with a handle portion 3. Although not illustrated in FIG. 14, it will be understood that the body will have a working cylinder, a piston and driver assembly, a nose piece, a fastener magazine, a firing valve assembly and an air return reservoir, all as described with respect to FIG. 1. These various elements operate in the same manner described above.

FIG. 14 illustrates the cap 6, exhaust port 72 and air reservoir 8. The upper end **15*b* of the workpiece responsive trip 15 is also shown. A manual trigger 151 is substantially the same as manual trigger 13 of FIG. 1 and is pivoted to the tool body as at 152. A lever 153, substantially identical to lever 16 of FIG. 1 is pivoted to the manual trigger 151 as at 154. The lever 153 cooperates with the upper end 15*b* of the workpiece responsive trip in substantially the same way described with respect to FIG. 1**, as will be hereinafter pointed out.

The tool of FIG. 14 is provided with a remote valve assembly 155. The remote valve assembly differs in certain respects from remote valve assembly 12 of FIGS. 1, 2 through 7 and 12 but serves the same purpose. As in the case of the embodiment of FIGS. 1 and 2, the lower part of the tool housing handle portion is again provided with three concentric bores 38, 39 and 40. The upper part of the housing handle portion is provided with bores 41 and 42, concentric with each other and with bores 38 through 40. The remote valve assembly 155 is held within bores 38 through 42 in the same manner described with respect to remote valve assembly 12. Finally, the bore 41 in the upper portion of the tool housing handle portion has the lateral passage 27 leading to the space above the firing valve (not shown). Similarly, bore 38 is provided with lateral passage 119 leading to bore 120. In the embodiment of FIGS. 15 through 17 the bore 120 and passage 119 are not required and may be eliminated. If bore 120 and passage 119 are present, bore 120 must be plugged ans is therefore illustrated as being plugged by element 156. Finally, the passage 136 from the air return reservoir (not shown) is also illustrated in FIG. 14.

REMOTE VALVE ASSEMBLY — GENERAL

Remote valve assembly 155 may be identical to that taught in U.S. Pat. No. 3,808,620. Remote valve assembly 155 is made up of five basic parts comprising a valve housing 157, a remote cage 158, a trigger core housing 159, a trigger core 160 and a remote core 161.

The lower end of valve housing 157 is received within bore 38 with a sliding fit. The lowermost end of the valve housing is provided with a plurality of radial notches 162. Thereabove, there is an annular exterior boss 163 having an O-ring 164 sealingly engaging the interior surface of bore 38. At its upper end, the valve housing 157 has a first boss 165 carrying an O-ring 166 and a second boss 167 carrying an O-ring 168. The bosses 165 and 167 are separated by a portion of reduced diameter having a plurality of radial ports 169 therethrough. Immediately below boss 165 additional radial ports are shown at 170. Interiorly, the valve housing 157 has a smooth cylindrical surface 171 which extends from its lowermost end to the radial ports 170. In the region of bosses 165 and 167 and radial ports 169 the valve housing has a cylindrical interior surface 172 of lesser diameter than the interior cylindrical surface 171. Finally, at its uppermost end, the valve housing 157 has a plurality of radial notches 173.

As in remote valve assembly 12 of FIG. 2, the remote cage 158 of the remote valve assembly 155 is a generally cylindrical member having annular exterior bosses 173 and 174 bearing O-rings 175 and 176, respectively. O-ring 175 makes a sealing engagement with the interior surface of bore 41. O-ring 176 makes a sealing engagement with the shoulder between bores 41 and 42. Below boss 174 the remote cage has an annular portion 177 having an external diameter substantially equivalent to the diameter of bore 42. Internally, remote cage 158 has a lower bore 178 with which the O-ring 166 of valve housing 157 may make sealing engagement. Thereabove, the remote cage has a bore 179 of larger diameter. This is surmounted by a bore 180 of a diameter substantially equivalent to the bore 178 and provides a surface with which O-ring 168 on valve housing 157 may make sealing engagement. Between bosses 173 and 174 the remote cage has a plurality of radial ports 181. Finally, the upper end of the remote cage terminates in an annular portion 182 having a plurality of radial ports 183. Remote cage 158 is fixedly located within bores 41 and 42, being held in place by tool cap 6.

The trigger core housing 159 comprises a generally cylindrical member having near its lower end a pair of bosses 184 and 185 bearing O-rings 186 and 187, respectively. O-ring 186 makes sealing contact with bore 39 in the housing handle portion 3. O-ring 187 makes sealing contact with the internal surface 171 of valve housing 157. Above boss 185 the trigger core housing 159 is provided with a plurality of radial ports 188.

Interiorly, trigger core housing 159 has a first axial bore 189. This is followed by a second axial bore 190 of slightly larger diameter and a third axial bore 191 of yet larger diameter. These internal bores of trigger core housing 159 are intended to slidingly receive trigger core 160 and a portion of the remote core 161.

Trigger core 160 comprises a rod-like element terminating at its lowermost end in a rounded nose 192. An its uppermost end the trigger core 160 has a portion 193 of slightly larger diameter bearing an O-ring 194. The O-ring 194 is capable of making sealing contact with the internal bore 190 of the trigger core housing 159. Intermediate its ends, the trigger core 160 carries a second O-ring 195. When the trigger core is in its normal position, the O-ring 195 is immediately below bore 189 of trigger core housing 159. When the trigger core is actuated, O-ring 195 makes sealing contact with the internal surface 189 of trigger core housing 159.

In FIG. 14 the trigger core 160 is illustrated in its lowermost or normal position. The trigger core is normally biased to this position by air under pressure from reservoir 8. In addition to this, the trigger core is additionaly biased to its normal position by a compression spring 196. The upper end of compression spring 196 abuts the bottom edge of the trigger core housing 159. The lower end of compression spring 196 abuts a retaining ring 197 captively affixed to the trigger core nose.

The final element of valve assembly 155 is the remote core 161. The remote core comprises an elongated member, the lower end of which is receivable within bore 191 of trigger core housing 159. This lower end of the remote core carries an O-ring 198 sealingly engaging the interior surface 191 of trigger core housing 159. Thereabove, the remote core has an annular boss 199 carrying an O-ring 200 adapted to sealingly engage the interior surface 171 of valve housing 157. The remote core, above boss 199, diminishes slightly in diameter and is provided with another boss 201 carrying an O-ring 202. O-ring 202 is capable of making sealing engagement with the interior surface 172 of valve housing 157. Above boss 201 the remote core again diminishes slightly in diameter and is provided with yet another boss 203 carrying an O-ring 204 making sealing engagement with the interior surface 172 of valve housing 157. The uppermost end of the remote core 161 protrudes slightly above boss 203 forming a nose 205.

The remote core 161, as will be developed later, is normally biased to its lowermost position as illustrated in FIG. 14 by air under pressure from reservoir 8. in addition, a compression spring 206 assists in biasing the remote core to its lowermost position. The lower end of compression spring 206 extends about the upper nose 205 of the remote core and seats upon boss 203. The upper end of compression spring 206 abuts the inside surface of tool cap 6.

Finally, the remote core is provided with an axial passage 207 which extends from the lowermost end of the remote core to a transverse passage 208 located between bosses 199 and 201.

MANUAL TRIGGER — ACTUATED VALVE ASSEMBLY

In the embodiment of FIGS. 14 through 17, the lower portion of the tool housing handle portion 3 is provided with a bore 209 adapted to receive a manual trigger-actuated valve assembly generally indicated at 210. The bore 209 has an intermediate annular notch 211 and is threaded as at 212 near its lower end. The valve assembly 210 comprises a valve housing 213 and a valve core 214.

Valve housing 213 is generally cylindrical and terminates at its lower end in an annular rim 213*a*. Near the annular rim, the valve housing is externally threaded as at 215 so that it may be engaged with threads 212 of bore 209. An O-ring 216 is located between valve housing annular rim 214 and that portion of the tool housing handle portion 3 adjacent thereto. Near its upper end, the valve housing 213 has an O-ring 217 sealingly engaging the interior surface of bore 209.

Interiorly, valve housing 213 has at its lower end a first bore 218. This is followed by a second bore 219 of slightly lesser diameter and a third bore 220 having a diameter substantially the same as bore 218. The bores 218 through 220 are adapted to receive valve core 214. Finally, valve housing 213 has a plurality of radial bores 221 extending between valve housing bore 219 and the annular notch 211 in the tool housing handle portion bore 209.

The valve core comprises an elongated member the lower portion of which has a diameter substantially equivalent to the internal diameter of valve housing bore 219. Near its lower end, the valve core carries an O-ring 222 which may sealingly engage the interior surface 219 of valve housing 213 when the core 214 is in its actuated position, as will be described hereinafter. At its upper end, the valve core 214 has a portion 223 of a diameter substantially equivalent to the diameter of valve housing bore 220 and carrying an O-ring 224 adapted to sealingly engage the interior surface of valve housing bore 220.

TIMING VALVE

In the embodiment of FIGS. 14 through 17 a timing valve is provided. The timing valve is diagrammatically illustrated in the drawings and is generally indicated by index numeral 225. Timing valve 225 is shiftable by air under pressure between a normal position illustrated in FIGS. 14 through 16 and a lock-out means actuating position shown in FIG. 17. The timing valve 225 is biased to its normal position by spring means 226. As will be developed hereinafter, the valve 225 may also be shifted to its normal position by air under pressure in an air line 227 connected to the air return reservoir (see FIG. 1). For purposes of this exemplary showing, the line 227 is illustrated as being connected to passage 136 from the air return reservoir.

Timing valve 225 may be shifted to its lock-out means actuating position (FIG. 17) by air under pressure in line 228. Line 228 is connected between timing valve 225 and the annular groove 211 surrounding the manual trigger-actuated valve assembly 210 and communicating with radial ports 221 in valve housing 213. A line 229 is connected between timing valve 225 and reservoir 8. Similarly, a line 230 is connected between timing valve 225 and the lower end of bore 38 in the tool housing handle portion 3. The purpose of timing valve 225 and the various lines to it will be described hereinafter.

METERING ORIFICE

To complete the embodiment of the safety means of FIGS. 14 through 17, line 228 extending between annular notch 211 surrounding the manually actuated trigger valve assembly 210 and timing valve 225 is provided with a metering orifice 231. The metering orifice 231 regulates the passage of air from annular notch 211 to the timing valve 225. In this way, metering orifice 231 serves substantially the same purpose as metering orifice 117 in FIGS. 10 and 11, for example. That is, metering orifice 231 determines the duration of the time delay.

It will be noticed that a by-pass line 232 extends about metering orifice 231 and contains a check valve 233. As noted above, air passing from annular notch 211 to the timing valve 225 must pass through metering orifice 231. This air cannot go through by-pass line 232 by virtue of check valve 233. On the other hand, air passing in the opposite direction (i.e. from timing valve 225 to the annular notch 211) will pass through check valve 233 in by-pass line 232, avoiding metering orifice 231).

OPERATION OF THE EMBODIMENT OF FIGS. 14 THROUGH 17

In FIG. 14, the tool and its associated parts are shown in the normal, unfired position. Both the workpiece responsive trip 15 and the manually actuated trigger 151 are in their normal, unactuated positions.

Valve housing 157 of the remote valve assembly 155 is shiftable vertically in the same manner described with respect to valve housing 34 in FIGS. 2 through 7. Air under pressure from reservoir 8, acting upon the lower exterior boss 163 of valve housing 157 will normally maintain the valve housing in its lowermost position. In similar fashion, air under pressure from reservoir 8 entering the valve housing 157 through ports 170 and passing through passages 208 and 207 in remote core 161 will act upon the upper end of trigger core 160. This, together with compression spring 196, will maintain trigger core 160 in its lowermost, unactuated position.

The same air under pressure from reservoir 8 entering passage 170 in the valve housing 157 will act upon boss 199 of remote core 161. This, together with compression spring 206, will maintain the remote core in its normal, lowermost position as illustrated in FIG. 14.

With the various elements of the remote valve assembly in the positions shown in FIG. 14, it will be evident that air under pressure from reservoir 8 entering ports 170 in the valve housing is free to pass through ports 169 in the upper portion of valve housing 157 and ports 181 in remote cage 158 to passage 27. As explained with respect to FIG. 1, air under pressure in passage 27 will act upon the upper end of the firing valve 7 (see FIG. 1) maintaining it closed and preventing firing of the tool. The air entering ports 170 in valve housing 157 cannot escape to atmosphere through vent passage 72 by virtue of O-ring 175 on remote cage 158, O-ring 168 at the upper end of valve housing 157 and O-ring 204 at the upper end of remote core 161. This same air passing through passages 208 and 207 in remote core 161 is effectively blocked by O-ring 198 at the lowermost end of remote core 161 and O-ring 194 at the uppermost end of trigger core 160.

Since trigger actuated valve assembly 210 is not actuated by manual trigger 151, air from reservoir 8 is blocked by O-ring 224 on valve core 214 and does not enter radial passages 221, annular notch 211 or line 228. Since O-ring 222 on core 214 is out of engagement with the interior surface 219 of valve housing 213, line 228, annular notch 211 and radial passages 221 are vented to atmosphere.

When the tool is in its unfired condition, it will be remembered that the air return reservoir 9 (see FIG. 1) is vented to atmosphere so that passage 136 and line 227 are similarly vented to atmosphere. With lines 227 and 228 vented to atmosphere, timing valve 225 is biased to its normal position (as shown in FIG. 14) by spring 226.

In its normal position, air from reservoir 8 in line 229 is effectively blocked by timing valve 225. At the same time, the area surrounding the lower portion of trigger core housing 159 and beneath valve housing 157 is vented to atmosphere since passage 119 and line 230 are vented to atmosphere by timing valve 225 as at 225*a*.

The conditions of the tool just described are its normal unfired conditions and will remain unchanged until the manual trigger 151 is actuated. Actuation of the workpiece responsive trip 15, alone, will not change these conditions. This is shown in FIG. 14. If the workpiece responsive trip 15 is placed against a workpiece, lever 153 will be shifted to its position shown in broken lines at 153*a*. As shown, the lever will still not contact nose 192 of the trigger core 160 of remote valve assembly 155 with the result that the unfired conditions will remain unchanged.

FIG. 15 illustrates the conditions of the tool when fired. Under these circumstances, it is to be assumed that the workpiece responsive trip 15 and the manual trigger 151 were shifted to their firing positions within the time limit imposed by the safety means of the present invention.

Turning first to the remote valve assembly 155 of FIG. 15, it will be noted that lever 153 has contacted the nose 192 of trigger core 160, shifting trigger core 160 to its actuated position against the air under pressure from reservoir 8 acting upon the trigger core and against the action of compression spring 196. With trigger core 160 in its actuated position, air under pressure from reservoir 8 entering ports 170 in valve housing 157 and passages 208 and 207 in remote core 161 can now pass by O-ring 194 in the uppermost end of trigger core 160 and enter radial passage 188 in trigger core housing 159. This air from radial passage 188 enters the annular area between trigger core housing 159 and valve housing 157 to act upon the underside of boss 199 of remote core 161. This, together with the action of air under pressure on the underside of the lowermost end of remote core 161 and the underside of remote core boss 201 causes remote core 161 to shift to its uppermost position against the action of compression spring 206.

With the remote core 161 in its uppermost position, air under pressure from reservoir 8 entering radial ports 170 can no longer enter passage 27 by virtue of the sealing engagement between remote core O-ring 202 and the interior surface 172 of valve housing 157. On the other hand, the uppermost O-ring 204 of remote core 161 is no longer in sealing engagement with the interior surface 172 of valve housing 157 with the result that air above the firing valve (not shown) and in passage 27 is now free to pass through ports 183 in the uppermost end of remote cage 158 to the vent passage 72 and the firing valve is opened, firing the tool as described with respect to FIG. 1. In the meantime, actuation of manual trigger 151 has also resulted in the upward shifting of core 214 of the manual trigger-actuated valve assembly 210. This has released the sealing engagement between the interior surface 220 of valve housing 213 and O-ring 224 on core 214 with the result that air under pressure from reservoir 8 is now free to enter radial passage 221 and annular notch 211 which are no longer vented to atmosphere by virtue of the sealing engagement between O-ring 222 on core 214 and interior surface 219 of valve housing 213. This air passes through metering orifice 231. While air under pressure passing through metering orifice 231 tends, when sufficiently built up, to shift timing valve 225 to its lock-out actuating position, it will be remembered that at the completion of the downward stroke of piston and driver assembly 5, air under pressure will be present in the air return reservoir 9 (see FIG. 1). This air under pressure will also be present in passage 136 and therefore in line 227 maintaining the timing valve 225 in its normal position. Line 230 remains vented to atmosphere by timing valve 225 and line 229 remains blocked by timing valve 225 in the manner described with respect to FIG. 14.

FIG. 16 illustrates the second embodiment of the safety means of the present invention wherein the manual trigger 151 has been shifted to its actuated position, but the workpiece responsive trip 15 has not. Since, under these conditions, lever 153 does not contact the nose 192 of the trigger core 160 of remote valve assembly 155, the remote valve assembly will remain in the condition shown and described with respect to FIG. 14, the tool remaining unfired. With the manual trigger 151 in its actuated position, however, the core 214 of manual trigger-actuated valve assembly 210 is shifted to its actuated position as described with respect to FIG. 15. Thus, air under pressure from reservoir 8 is free to pass through metering orifice 231 to timing valve 225. As described with respect to FIG. 14, line 229 is still blocked by timing valve 225. Line 227 is still vented to atmosphere since air return reservoir 9 (FIG. 1) is still vented to atmosphere and timing valve 225 continues to vent line 230 to atmosphere.

If the workpiece responsive trip 15 is shifted to its actuated position within the time limit imposed by metering orifice 231 (i.e. before air under pressure passing through metering orifice 231 builds up to the point where it will shift timing valve 225 to its lock-out actuating position) the tool will fire and the conditions of the elements will be the same as described with respect to FIG. 15. If the workpiece responsive trip 15 is not shifted to its actuated position within the time limit imposed by metering orifice 231, the lock-out means will be actuated and the tool will be prevented from firing. The conditions of the tool under these latter circumstances are illustrated in FIG. 17.

In FIG. 17, the air from reservoir 8 passing through manual trigger-actuated valve assembly 210 and metering orifice 231 has built up to the extent that timing valve 225 has been shifted to its lock-out actuating position. Line 227 is still vented to atmosphere so that the air passing through metering orifice 231 need operate only to overcome spring 226 to shift timing valve 225.

In its shifted position, timing valve 225 directly connects line 229 from air reservoir 8 to line 230 leading to lower end of bore 38 in the tool housing handle portion 3. Thus, air under pressure from reservoir 8 enters the area beneath valve housing 157 of remote valve assembly 155 causing the valve housing 157 to shift upwardly. As in the embodiments of FIGS. 1 through 13, the valve housing 157 serves as the lock-out means. If, at this point, workpiece responsive trip 15 were shifted to its actuated position, causing lever 153 to contact nose 192 of trigger core 160, the trigger core 160 would move upwardly to the position shown in FIG. 15. This upward movement of trigger core 160 would cause an upward shifting of remote core 161 for the reasons given with respect to FIG. 15. However, since the valve housing 157 of remote valve assembly 155 (i.e. the lock-out means) has been shifted upwardly, the O-ring 202 of remote core 161 will not make sealing engagement with the interior surface 172 of valve housing 157 and the uppermost O-ring 204 of remote core 161 will remain in sealing engagement with the interior surface 172 of valve housing 157 with the result that air under pressure from reservoir 8 will continue to pass through passage 27 to the space above the firing valve (not shown), preventing firing of the tool.

It will be understood by one skilled in the art that if the workpiece responsive trip 15 were caused to be shifted to its normal position, the trigger core 160 and remote core 161 of remote valve assembly 155 will return to their lowermost positions illustrated in FIG. 17, but the valve housing 157 of remote valve assembly 155 will remain in its uppermost or lock-out position and the tool will remain disabled. Upon return of the manual trigger 151 to its normal position, the core 214 of manual trigger actuated valve assembly 210 will return to the position shown in FIG. 14 by virtue of air under pressure from reservoir 8 acting upon the uppermost end of the core 214. Under these circumstances, O-ring 222 of core 214 will shift out of sealing engagement with the interior surface 219 of valve housing 213 causing line 228, annular notch 211 and radial ports 221 to be vented to atmosphere. The air under pressure which shifted timing valve 225 to its lock-out position will be vented through by-pass line 232 and check valve 233 to atmosphere. This will enable spring 226 to return timing valve 225 to its normal position illustrated in FIG. 14. Line 229 from air reservoir 8 will now be disconnected from line 230 and line 230 will be vented to atmosphere again by timing valve 225. Thus, upon release of manual trigger 151, the conditions of the tool will return to those illustrated and described with respect to FIG. 14.

It will be evident from the above description of FIGS. 14 through 17 that in this embodiment of the safety means of the present invention the time delay can only be initiated by the manually actuated trigger 151 and once the lock-out means has been actuated, it can only be deactivated by return of the manual trigger 151 to its normal position. Thus, if the lock-out means has been actuated and the workpiece responsive trip 15 has thereafter been shifted to its firing position, it is only necessary to release the manually actuated trigger 151 to its normal position and return it to its firing position to fire the tool.

It will be understood by one skilled in the art that in the use of the tool embodiment of FIGS. 14 through 17 the operator may first depress the workpiece responsive trip 15 against the workpiece and the tool will fire upon actuation of manual trigger 151. However, the tool cycle will not be complete (i.e. the piston and driver assembly 5 will not return to their normal unfired position) until either the workpiece responsive trip 15 or the manual trigger 151 is returned to its normal position. It is possible for the operator to first actuate manual trigger 151 and thereafter repeatedly cause the tool to fire by repeatedly actuating the workpiece responsive trip against the workpiece, so long as the time delay between successive actuations of the workpiece responsive trip 15 falls within the time limit imposed by timing valve 225. It will be apparent that if that portion of line 228 between metering orifice 231 and timing valve 225 is of appreciable length and since it is not vented, a difference in time delay imposed by valve 225 could occur between the situation wherein the tool is repeatedly cycled by the workpiece responsive trip 15 with the manual trigger 151 held in actuated position as compared to simply picking up the tool and actuating the workpiece responsive trip 15 and manual trigger 151. This time delay difference would be caused by the fact that when the tool is repeatedly actuated by the workpiece responsive trip 15 with manual trigger 151 held in actuated position, pressurized air would be present in that portion of line 228 between metering orifice 231 and timing valve 225 between firings of the tool. Putting it another way, between such repetitive firings of the tool, the timing valve would not be returned to "O".

Line 228 in FIGS. 14 through 17 is diagrammatically represented. In the actual tool, that portion of line 228 between metering orifice 231 and timing valve 225 is made as short as possible. In fact, metering orifice 231 may indeed by incorporated in the housing of timing valve 225. In this way, this time difference can be rendered substantially unnoticable. That time required for air passing through metering orifice 231 to fill the distance between metering orifice 231 and timing valve 225 upon the first firing of the tool may simply be added to the desired time delay for which timing valve 225 is designed. In addition, between each firing of the tool initiated by the workpiece responsive trip 15 with the manual trigger 151 held in its actuated position, air passing through metering orifice 231 will displace timing valve 225 slightly toward its lock-out actuating position. Timing valve 225 may be so designed as to displace the air between it and metering orifice 231 through check valve 233 when pressurized air appears in line 227 upon the firing of the tool, the pressurized air in line 227 shifting valve 225 back to its normal position. Valve 225 may further be designed as to require a considerable amount of air to shift it from its normal position to its lock-out actuating position.

It would be within the scope of the invention to make metering orifice 231 of the variable type so that the time delay can be adjusted.

The embodiment of FIGS. 14 through 17 may be modified to render the tool capable of automatic firing. By this is meant that with both the workpiece responsive trip 15 and the manual trigger 151 in their actuated or firing positions, the tool will not only perform a full cycle without requiring the shifting of either the workpiece responsive trip 15 or the manual trigger 151 to its normal position, but also will continue to perform additional repetitive firing cycles so long as both triggering elements are in their actuated positions. Tools capable of this type of action are generally referred to in the art as "autofire" tools. U.S. Pat. No. 3,278,104 illustrates an exemplary autofire tool.

Figure 18:
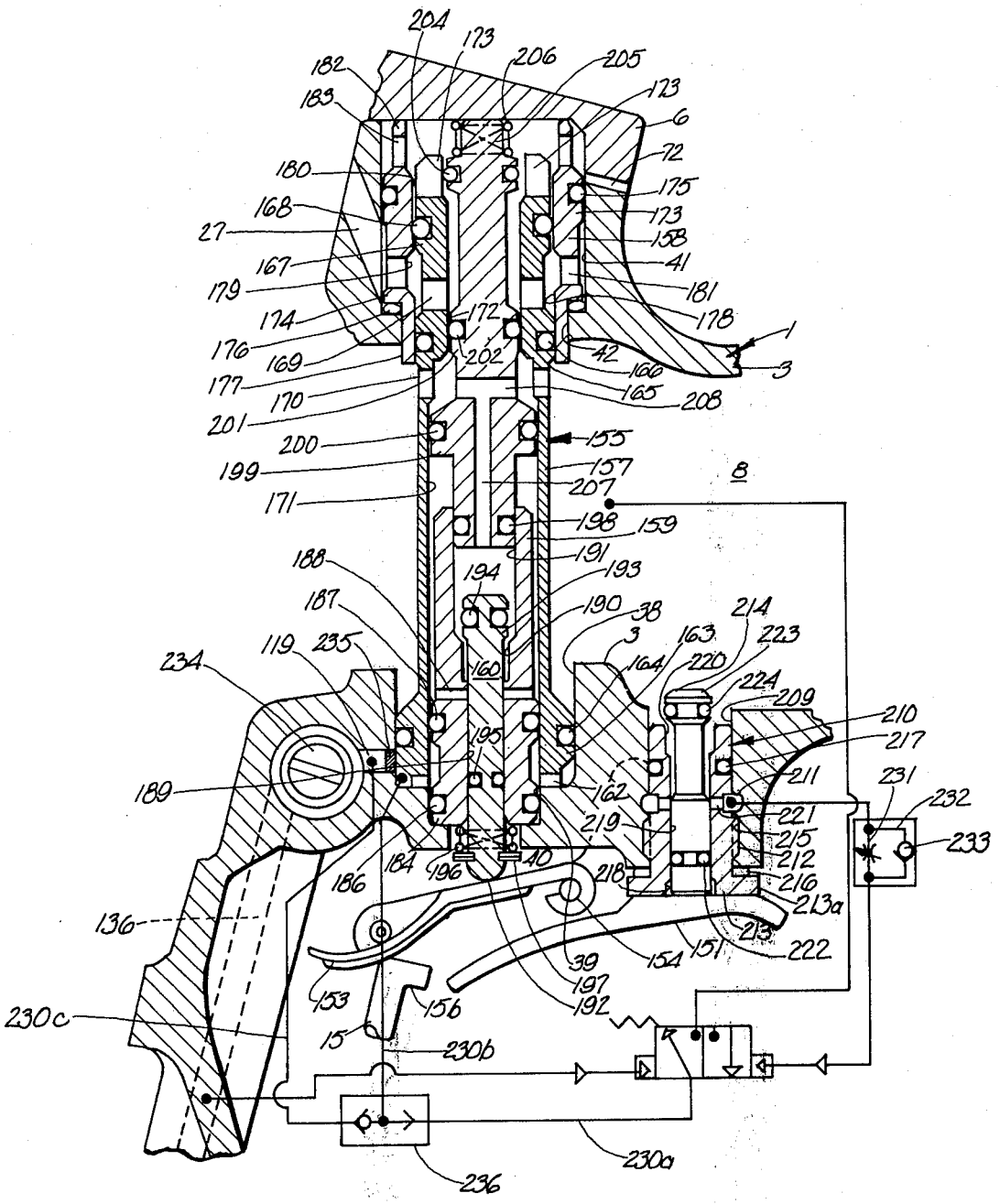
FIG. 18 is a fragmentary cross sectional elevational view (partially diagrammatic), similar to FIG. 15 and illustrating a modification wherein the tool is capable of controlled automatic continuous firing.

FIG. 18 illustrates the embodiment of FIGS. 14 through 17 modified so as to render the tool an autofire tool. Like parts have been given like index numerals. The embodiment of FIG. 18 differs from that of FIGS. 14 through 17 in that the plug 156 in bore 120 has been replaced by conventional autofire valve 234, of the type taught in the above mentioned U.S. patent and U.S. Pat. No. 3,730,414. The autofire valve 234 is manually settable between two positions. In its first position it serves simply as a plug for bore 120, similar to plug 156. In its second position it will permit the passage of air between passage 136 and passage 119. The opening of passage 119 into the lower end of bore 38 in the tool housing handle portion 3 is plugged by plug means 235.

The only other change in the embodiment of FIG. 18 is that made with respect to the line 230 of FIGS. 14 through 17. In FIG. 18 this line has a first portion **230*a* connecting timing valve 225 to a shuttle valve 236. A second portion 230*b* connects shuttle valve 236 to the lower end of bore 38 in the tool housing handle portion 3. A third portion 230*c* connects shuttle valve 236 to passage 119.**

FIG. 18 illustrates the shuttle valve 236 in its normal position. When autofire valve 234 is in its first position (i.e. serving the same purpose as plug 156 in FIGS. 14 through 17), lines **230*a* and 230*b* will be connected by the shuttle valve and will be equivalent to line 230 of FIGS. 14 through 17. As a consequence, the operation of the tool will be identical to that described with respect to FIGS. 14 through 17.**

When autofire valve 234 is in its second position (i.e. making a connection between passage 136 and passage 119), the tool will be in its autofire mode. Thus, when both the workpiece responsive trip 15 and the manual trigger 151 are shifted to their actuated positions, the tool will fire. As explained with respect to FIG. 1, firing of the tool will provide air under pressure in air return reservoir 9. This air under pressure will pass through passage 136, autofire valve 234 and line **230*c* causing shuttle valve 236 to shift to its other position (not shown) effectively cutting off line 230*a* and joining lines 230*c* and 230*b*. Pressurized air in line 230*b*, and thus in the lower end of bore 38 in the tool housing handle portion 3, will cause valve housing 157 to shift upwardly. This, in turn, will vent to atmosphere through vent passage 72 that air in the space above the firing valve (not shown) causing the firing valve to close and the tool to complete its firing cycle. With the firing cycle complete, the air return reservoir 9 is vented to atmosphere which, in turn, will vent passage 136, autofire valve 234, passage 119, line 230*c*, line 230*b* and the lower end of bore 38 in the tool housing handle portion 3 to atmosphere. This causes valve housing 157 to return to its lower position under the influence of air under pressure from reservoir 8 and the firing cycle will automatically continue to repeat in this fashion. Upon the return of one of the workpiece responsive trip 15 and the manual trigger 151** to its normal position, the tool will stop firing.

At the beginning of an autofire operation with the autofire valve 234 set in its second position, if the manual trigger 151 is shifted to its actuated position and the workpiece responsive trip is shifted to its actuated position after the passage of the time limit imposed by timing valve 225, the safety device of the present invention will come into play. Timing valve 225 will be shifted to its lock-out actuating position by air flowing through metering orifice 231. This will connect line 230*a* (normally vented to atmosphere by timing valve 225) to line 229. Pressurized air from reservoir 8 passing through line 229, timing valve 225 and line 230*a* will shift shuttle valve 236 to its normal position, as shown, connecting line 230*a* with line 230*b*. This introduces air under pressure from reservoir 8 into the lower end of bore 38 in the tool housing handle portion 3, shifting valve housing 155 to its upper or lock-out position and maintaining it there until manual trigger 151 is released to its normal position.

Modifications may be made in the invention without departing from the spirit of it.

The embodiments of the invention in which an exclusive property or privilege is claimed are defined as follows:

1. In a pneumatically actuated fastener applying tool with a fastener containing magazine, the tool being of the type having firing control means comprising two separate and independent triggering means shiftable independently and in any order between normal and firing positions and required to be concurrently in their firing positions to actuate said tool, the improvement comprising safety means providing a time limit within which both of said triggering means must achieve their firing positions to fire said tool.

2. The structure claimed in claim 1 including means to adjust the duration of said time limit.

3. The structure claimed in claim 1 including means to initiate said time limit upon the shifting of one of said independent triggering means to its firing position.

4. The structure claimed in claim 1 including means to cancel said time limit upon the firing of said tool.

5. The structure claimed in claim 1 wherein said independent triggering means comprises a manual trigger and a workpiece responsive trip.

6. The structure claimed in claim 1 including means providing said tool with a first firing mode wherein at least one of said independent triggering means must be returned to its normal position after the firing of said tool and a second mode wherein said tool fires repeatedly and automatically after both independent triggering means have achieved their firing positions within said time limit and until one of said triggering means is shifted to its normal position.

7. The structure claimed in claim 1 including lock-out means operatively connected to said safety means to prevent firing of said tool if both of said independent triggering means do not achieve their firing positions within said time limit.

8. The structure claimed in claim 7 including means to deactivate said lock-out means when one of said independent triggering means is returned to its normal position.

9. In a fastener applying tool with a fastener containing magazine, said tool being adapted to be connected to a source of air under pressure and having a pneumatically actuated firing valve assembly controlling the flow of said air under pressure, a cylinder and a piston-driver assembly reciprocable therein under control of said firing valve assembly, a remote valve assembly controlling the opening of said firing valve assembly to stroke said piston-driver assembly, and firing control means comprising two separate and independent triggering means shiftable independently and in any order between normal positions and firing positions and actuating said remote valve assembly to open said firing valve assembly when both of said triggering means are concurrently in their firing positions, the improvement comprising safety means providing a time limit within which both of said independent triggering means must achieve their firing positions to actuate said remote valve assembly to open said firing valve assembly and stroke said piston-driver assembly.

10. The structure claimed in claim 9 including means to adjust the duration of said time limit.

11. The structure claimed in claim 9 including means to initiate said time limit upon the shifting of either one of said independent triggering means to its firing position.

12. The structure claimed in claim 9 including means to cancel said time limit upon the stroking of said piston.

13. The structure claimed in claim 9 wherein said independent triggering means comprise a manual trigger and a workpiece responsive trip.

14. The structure claimed in claim 9 including means providing said tool with a first firing mode wherein at least one of said independent triggering means must be returned to its normal position after the firing of said tool and a second mode wherein said tool fires repeatedly and automatically after both independent triggering means have achieved their firing positions within said time limit and until one of said triggering means is shifted to its normal position.

15. The structure claimed in claim 9 including lock-out means operatively connected to said safety means to prevent opening of said firing valve assembly if both of said independent triggering means do not achieve their firing positions within said time limit even though said remote valve assmbly has been actuated.

16. The structure claimed in claim 15 including means to deactivate said lock-out means when both of said independent triggering means are returned to their normal positions.

17. The structure claimed in claim 15 wherein said safety means comprises at least one metering orifice and an auxiliary air reservoir, means for connecting said metering orifice to said auxiliary reservoir, said lock-out means being shiftable between an inoperative position and a lock-out position wherein it prevents the opening of said firing valve assembly and the stroking of said piston-driver assembly, means for normally biasing said lock-out means to said inoperative position, means operatively connecting said lock-out means to said auxiliary reservoir to shift said lock-out means to said lock-out position by air under pressure within said auxiliary reservoir when the pressure of air therein equals the pressure of said air from said source, said at least one metering orifice and said auxiliary reservoir being so sized as to determine the duration of said time limit, means to introduce air under pressure from said source through said metering orifice and into said auxiliary reservoir to initiate said time limit upon the shifting of one of said independent triggering means to said firing position, means to vent to atmosphere said air within said auxiliary reservoir after each stroking of said piston-driver assembly and means to vent to atmosphere said air within said auxiliary reservoir after shifting of said lock-out means to said lock-out position and upon concurrent location of both of said independent triggering means in their normal positions.

18. The structure claimed in claim 17 including means to vary the size of said metering orifice whereby to adjust the duration of said time limit.

19. The structure claimed in claim 17 including means to vary the volume of said safety reservoir whereby to adjust the duration of said time limit.

20. The structure claimed in claim 17 wherein said remote valve comprises a hollow valve housing having a first port communicating with said source of air under pressure and a second port communicating with said firing valve assembly, said valve housing comprising said lock-out means and being shiftable axially between a normal lowermost position comprising said inoperative position and an uppermost position comprising said lock-out position, the upper end of said valve housing being open and in communication with an exhaust passage to atmosphere, a remote core located within said valve housing and shiftable axially therein between a lower position and an upper position, air under pressure from said source entering said first port in said hollow valve housing normally biasing said remote core to said lower position, means to cause said air under pressure from said source entering said first port of said hollow valve housing to shift said remote core to said upper position, said remote core being so configured as to connect said source of air under pressure to said firing valve assembly to maintain said firing valve assembly closed and prevent stroking of said piston-driver assembly when said valve housing is in said normal inoperative position and said remote core is in said lower position and when said valve housing is in said lock-out position and said remote core is in either of said lower and upper positions, said remote core being so configured as to connect said firing valve assembly to said exhaust passage causing said firing valve assembly to open and said piston-driver assembly to stroke when said valve housing is in said normal inoperative position and said remote core is in said upper position.

21. The structure claimed in claim 20 wherein said remote valve assembly includes a trigger core housing located within said valve housing below said remote core and a trigger core slidable axially within said trigger core housing from a lowermost normal position through an intermediate position and to an uppermost position, said trigger core housing and said trigger core being so configured as to prevent said air under pressure from said source from shifting said remote core to said upper position and to connect said auxiliary reservoir and said metering orifice to atmosphere when said trigger core is in said lowermost position, said trigger core housing and trigger core being so configured as to prevent said air under pressure from said source from shifting said remote core to said upper position, to seal said auxiliary reservoir and metering orifice from atmosphere and to permit said air under pressure from said source to enter said auxiliary reservoir through said metering orifice when said trigger core is in said intermediate position, said trigger core housing and said trigger core being so configured as to permit said air under pressure from said source to shift said remote core to said upper position, to seal said auxiliary reservoir and said metering orifice from atmosphere and to permit said air under pressure from said source to enter said auxiliary reservoir through said metering orifice when said trigger core is in said uppermost position, said trigger core being normally biased to said lowermost position by said air under pressure from said source, said trigger core being shiftable to said intermediate position by shifting either of said independent triggering means to its firing position and said trigger core being shifted to said uppermost position by both of said independent triggering means when in their firing positions.

22. The structure claimed in claim 21 including an exhaust valve assembly connecting said auxiliary reservoir to atmosphere when open and means to open said exhaust valve upon the stroking of said piston-driver assembly.

23. In a fastener applying tool having a fastener containing magazine, said tool being adpated to be connected to a source of air under pressure and having a pneumatically actuated firing valve assembly controlling the flow of said air under pressure, a cylinder and a piston-driver assembly reciprocable therein under control of said firing valve assembly, a remote valve assembly controlling the opening of said firing valve assembly to stroke said piston-drive assembly, firing control means comprising two separate and independent triggering means shiftable independently and in any order between normal positions and firing positions and actuating said remote valve asseassembly to open said firing valve assembly when both of said triggering means are concurrently in their firing positions, the improvement comprising safety means providing a time limit within which both of said independent triggering means must achieve their firing positions to actuate said remote valve assembly, said time limit being initiated by shifting a preselected one of said independent triggering means to its firing position.

24. The structure claimed in claim 23 including lock-out means operatively connected to said safety means to prevent opening of said firing valve assembly if both of said independent triggering means do not achieve their firing positions within said time limit even tough said remote valve assembly has been actuated.

25. The structure claimed in claim 24 including means to deactivate said lock-out means when said preselected triggering means is returned to its normal position.

26. The structure claimed in claim 24 wherein said independent triggering means comprise a manual trigger and a workpiece responsive trip.

27. The structure claimed in claim 24 including means providing said tool with a first firing mode wherein at least one of said independent triggering means must be returned to its normal position after the firing of said tool and a second mode wherein said tool fires repeatedly and automatically after both independent triggering means have achieved their firing positions within said time limit and until one of said triggering means is shifted to its normal position.

28. The structure claimed in claim 26 wherein said manual trigger comprises said preselected triggering means.

29. The structure claimed in claim 28 wherein said lock-out means is shiftable between an inoperative position and a lock-out position wherein it prevents the opening of said firing valve assembly and the stroking of said piston-driver assembly, means for normally biasing said lock-out means to said inoperative position, said lock-out means being shiftable to said lock-out position by air under pressure from said source, said safety means comprising a timing valve and a manual trigger-actuated valve assembly, said timing valve being shiftable by air under pressure from said source from a normal position to a lock-out actuating position wherein it connects said lock-out means to said source of air under pressure to shift said lock-out means to said lock-out position, means to bias said timing valve to said normal position, said manual trigger-actuated valve assembly being shiftable from a closed position to an open position by shifting said manual trigger from its normal to its firing position, means connecting said manual trigger-actuated valve to said timing valve, a metering orifice in said last mentioned means, said manual trigger-actuated valve assembly when in said open position connecting said timing valve through said metering orifice to said source of air under pressure to shift said timing valve to said lock-out actuating position after the passage of said time limit determined by said metering orifice.

* * * * *